US012484696B2

(12) United States Patent
Isele

(10) Patent No.: US 12,484,696 B2
(45) Date of Patent: Dec. 2, 2025

(54) DRAWER PULL-OUT GUIDE FOR MOVABLY SUPPORTING A DRAWER ON A FURNITURE BODY

(71) Applicant: Julius Blum GmbH, Hoechst (AT)

(72) Inventor: Olaf Isele, Lustenau (AT)

(73) Assignee: JULIUS BLUM GMBH, Hoechst (AT)

( * ) Notice: Subject to any disclaimer, the term of this patent is extended or adjusted under 35 U.S.C. 154(b) by 55 days.

(21) Appl. No.: 18/416,444

(22) Filed: Jan. 18, 2024

(65) Prior Publication Data

US 2024/0156260 A1 May 16, 2024

Related U.S. Application Data

(63) Continuation of application No. PCT/AT2022/060256, filed on Jul. 19, 2022.

(30) Foreign Application Priority Data

Jul. 23, 2021 (AT) ..... A 50613/2021

(51) Int. Cl.
*A47B 88/483* (2017.01)

(52) U.S. Cl.
CPC ..... *A47B 88/483* (2017.01)

(58) Field of Classification Search
CPC ..... A47B 88/483; A47B 88/43; A47B 88/49; A47B 88/40; A47B 88/477; A47B 88/493;

(Continued)

(56) References Cited

U.S. PATENT DOCUMENTS 1,545,016 A * 7/1925 Sessions ..... A47B 88/483 248/248
1,798,876 A * 3/1931 Geimer ..... A47B 88/483 312/334.1

(Continued)

FOREIGN PATENT DOCUMENTS

AT 508129 B1 * 11/2010 ..... A47B 88/43
AT 508160 B1 * 2/2011 ..... A47B 88/43

(Continued)

OTHER PUBLICATIONS

International Search Report issued Oct. 25, 2022 in International (PCT) Application No. PCT/AT2022/060256.

*Primary Examiner* — Hanh V Tran
(74) *Attorney, Agent, or Firm* — Wenderoth, Lind & Ponack, L.L.P.

(57) ABSTRACT

A drawer pull-out guide includes a body rail to be secured to a furniture body, and a drawer rail to be connected to a drawer and movably mounted relative to the body rail in a longitudinal direction. At least one of the rails has a profiled section made of a flat sheet metal and having two longitudinal edges running parallel to each other, in a cross-section normal to the longitudinal direction. An embossing extending at least partly over at least two profiled section lateral surfaces arranged substantially orthogonally to each other is provided to reinforce the profiled section of the at least one of the rails. The lateral surfaces are arranged in the longitudinal direction, and the embossing is arranged substantially orthogonal to the longitudinal direction. The embossing faces toward an outer region of the rail, and/or the rail is a storage rail, and/or at least two embossings are provided.

25 Claims, 11 Drawing Sheets

(58) Field of Classification Search
CPC .... A47B 2210/0021; A47B 2210/0035; A47B 2210/0056
See application file for complete search history.

(56) References Cited

U.S. PATENT DOCUMENTS

| | | | | | |
|---|---|---|---|---|---|
| 2,222,842 | A * | 11/1940 | Humphrey | B21C 37/157 | 83/72 |
| 3,777,530 | A * | 12/1973 | Jansson | B21C 37/02 | 72/181 |
| 4,072,375 | A * | 2/1978 | Boone | A47B 88/49 | 312/334.8 |
| 4,305,625 | A * | 12/1981 | Gutner | A47B 88/483 | 384/19 |
| RE32,134 | E * | 5/1986 | Gutner | A47B 88/483 | 384/19 |
| 4,832,509 | A * | 5/1989 | Merrifield | A47B 88/487 | 312/334.44 |
| 6,485,120 | B1 * | 11/2002 | Pomerleau | A47B 88/427 | 312/334.44 |
| 6,854,817 | B1 * | 2/2005 | Simon | A47B 88/43 | 312/334.6 |
| 7,562,950 | B2 | 7/2009 | Lam et al. | | |
| 8,882,351 | B2 * | 11/2014 | Jahrling | F24C 15/168 | 312/334.45 |
| 9,651,088 | B2 * | 5/2017 | Park | F16C 33/40 | |
| 9,993,857 | B2 * | 6/2018 | Schneider | B21B 1/24 | |
| 10,159,164 | B2 * | 12/2018 | Liao | A47B 88/43 | |
| 10,314,398 | B2 * | 6/2019 | Bowman | A47B 88/487 | |
| 2006/0214548 | A1 | 9/2006 | Lam et al. | | |
| 2009/0019804 | A1 * | 1/2009 | Spielman | E04C 3/07 | 52/592.1 |
| 2015/0002008 | A1 * | 1/2015 | Domenig | B21D 35/001 | 312/334.8 |
| 2015/0159415 | A1 | 6/2015 | Rehage et al. | | |
| 2017/0254081 | A1 | 9/2017 | Castellucci | | |
| 2020/0337457 | A1 | 10/2020 | Meusburger et al. | | |
| 2021/0022498 | A1 * | 1/2021 | Zhan | A47B 88/437 | |
| 2022/0218106 | A1 * | 7/2022 | Netzer | A47B 88/477 | |
| 2022/0304466 | A1 * | 9/2022 | He | A47B 88/447 | |
| 2023/0157449 | A1 * | 5/2023 | Isele | E05D 9/00 | 312/294 |

FOREIGN PATENT DOCUMENTS

| | | | | |
|---|---|---|---|---|
| AT | 518077 | A4 * | 7/2017 | A47B 88/40 |
| AT | 520404 | A1 * | 3/2019 | A47B 88/487 |
| DE | 3632442 | A1 * | 3/1988 | A47B 88/407 |
| DE | 4108885 | A1 * | 10/1991 | A47B 88/467 |
| DE | 19641144 | A1 * | 4/1998 | B23D 31/002 |
| DE | 29803210 | U1 * | 5/1998 | |
| DE | 102007018927 | A1 * | 10/2008 | B26F 3/04 |
| DE | 202008013003 | U1 * | 2/2010 | A47B 88/487 |
| DE | 20 2009 003 459 | | 8/2010 | |
| DE | 10 2013 010 577 | | 12/2014 | |
| DE | 10 2013 111 076 | | 4/2015 | |
| DE | 10 2016 125 028 | | 6/2017 | |
| DE | 10 2019 111 292 | | 11/2020 | |
| DE | 10 2019 111 655 | | 11/2020 | |
| DE | 102019111655 | A1 * | 11/2020 | A47B 88/423 |
| EP | 2 168 457 | | 3/2010 | |
| EP | 2 429 340 | | 8/2013 | |
| EP | 3 769 646 | | 1/2021 | |
| JP | 2017-530010 | | 10/2017 | |
| JP | 2021-509851 | | 4/2021 | |
| MY | 131063 | A * | 7/2007 | A47B 88/447 |
| TW | M404654 | | 6/2011 | |
| WO | 2004/103119 | | 12/2004 | |
| WO | WO-2009009626 | A1 * | 1/2009 | E04C 3/07 |
| WO | WO-2019119004 | A1 * | 6/2019 | A47B 88/473 |
| WO | 2020/221669 | | 11/2020 | |

* cited by examiner

DRAWER PULL-OUT GUIDE FOR MOVABLY SUPPORTING A DRAWER ON A FURNITURE BODY

BACKGROUND OF THE INVENTION

The invention relates to a drawer pull-out guide for movably mounting a drawer on a furniture carcass. The invention also relates to a method for producing at least one such drawer pull-out guide.

The requirement for metal, which is necessary for the production of a rail, represents a general problem in the manufacture of rails, in particular for the furniture industry. High material usage leads to a high weight and to increased costs in series manufacturing. It is therefore desirable to use as little metal as possible, especially as a resource-conserving use of raw materials brings with it both ecological and economic advantages.

Such a drawer pull-out guide is already known from the document EP 2 429 340 B1, wherein, with regard to a resource-conserving use of raw materials, a reduction of basic material of a rail in a strip-shaped portion of reduced wall thickness is offset by local increases in wall thickness, in order to be able to maintain adequate strength properties of the rail. However, as this measure relates to a limited area of the rail for a specific area of application of the fastening of the rail, the material saving in relation to a total weight of the rail having the same functionality is limited.

Further drawer pull-out guides are known from the documents DE 10 2019 111 655 A1, DE 10 2013 111 076 A1, DE 10 2013 010 577 A1 and DE 10 2019 111 292 A1.

One measure for saving metal is the use of thin-walled metal sheets, wherein the weight of the rail can also be advantageously reduced. However, a disadvantage here is that, due to the weight reduction of the rail, in particular due to reduced moments of inertia/section moduli of the reduced cross-sectional area of the profile caused thereby, a load-bearing capacity of the rail is significantly reduced. The weight reduction of the rail accordingly corresponds to a reduced possible weight category of furniture parts which interact mechanically with the rail and can be operated properly with a practicable lifetime, with the result that this measure is not suitable for heavy furniture parts or high demand. However, there is a long-standing need in many respects, in particular in the furniture industry, to generate material savings using thin-walled rails, wherein, in relation to thicker-walled rails, an increased ratio of weight reduction of the rail to weight category of furniture parts which can be moved by the rail is obtained.

SUMMARY OF THE INVENTION

The objective technical problem of the present invention is therefore to specify a drawer pull-out guide that is improved compared with the state of the art and a method for producing such a drawer pull-out guide in which the disadvantages of the state of the art are at least partially remedied, and which are characterized in particular by a particularly favorable material reduction of the rail with a particularly high load-bearing capacity or strength/stability of the rail.

Accordingly:

at least one embossing extending at least in areas over at least two lateral surfaces of the profile arranged substantially orthogonal to each other is arranged for reinforcing the profile of the at least one rail, wherein the lateral surfaces are arranged in the longitudinal direction and the at least one embossing is arranged substantially orthogonal to the longitudinal direction, wherein the at least one embossing faces in the direction of an outer area of the at least one rail and/or the at least one rail is present in the form of the drawer rail, and/or at least two embossings are provided, which are preferably arranged on at least two lateral surfaces oriented substantially orthogonal to and/or adjoining each other and/or extend over at least two lateral surfaces at least in areas, wherein the at least two embossings face in the direction of an inner area and in the direction of an outer area of the at least one rail in an alternating manner, in particular wherein the at least two embossings adjoin each other in the longitudinal direction.

Both through the arrangement of the at least one embossing extending across at least two adjoining lateral surfaces of the profile and through the arrangement of the at least two embossings in alternating orientation on the at least one rail—in particular the at least one carcass rail, the at least one drawer rail and/or the at least one possibly present center rail—a reinforcement of the rail as such can be generated beyond a local increase in strength/stability.

A particularly effective increase in stability with reduced weight of the rail through material saving can for example be guaranteed if the embossings that are arranged in an alternating manner (towards the inside/outside) are arranged on two orthogonally adjoining lateral surfaces, preferably in an alternating manner (with respect to the arrangement on lateral surfaces), and/or extend across at least two orthogonally adjoining lateral surfaces.

In addition, the positioning of the at least one embossing in the longitudinal direction can be flexibly adapted to the demands on the at least one carcass rail and/or the at least one drawer rail, with the result that areas of the rail with particularly high loads are also equipped with a particularly high stability/strength due to the structural design via the at least one embossing.

According to the invention it is made possible that a degree of weight reduction of the at least one rail is higher than a degree of weight category reduction associated with the weight reduction (or weight reduction) of furniture parts to be moved by the rail. In the case of a given weight category of furniture parts to be moved, a material saving due to a reduction of the wall thickness of the metal sheet for forming the rail can be exploited. With the same weight, it is possible to move heavier furniture parts while keeping the same lifetime with proper use.

Added to this is the positive property that a force distribution, in particular during a bending process and/or during use of the rail, can be influenced particularly favorably in regions of the rail with high stress, wherein a geometric fidelity of the rail can in particular be guaranteed to a particularly high degree. In addition, in the case of an alternating arrangement of embossings relative to the inner area and the outer area and/or relative to two lateral surfaces, the process of bending a flat metal sheet to form a profile shape of the rail can be promoted, in order to be able to manufacture a profile with particularly high geometric precision, which can be maintained for the duration of use.

Under load, a rail tends to deform—in particular in the longitudinal direction—and to gape transverse to the longitudinal direction, wherein an angle between lateral surfaces of the profile increases in an undesired manner. The gaping of the profile under load is effectively prevented by the at least one embossing, wherein a deformation of the profile in the longitudinal direction is also effectively counteracted through an increase in a section modulus of the profile or in a stability/strength of the profile. Due to the at least one embossing, no additional component parts are required in order to realize this technical effect.

The technical term embossing in this context means a plastic deformation in the sense of a work hardening, which is driven into a metal sheet or a profile. Such reinforcements of thin-walled component parts against deformations are generally referred to as beads, wherein sharp-edged beads are referred to as folds. An embossing serves to increase stability or strength of the rail, in particular by increasing section moduli and/or moments of inertia across the profile of the rail, and is accompanied by a reduction of vibrations as well as deformations generated by pressure, tension, torsion, bending et cetera. A bead driven into the metal sheet in this context acts as a strengthening of the existing geometry of the rail.

In test runs, it was possible for example to reduce the weight of a conventional rail, as carcass rail, with a weight of 1134 g, due to the structural reconfiguration, and a reduced material thickness by 426 g for the same weight category of movable furniture parts to be applied.

The drawer pull-out guide can generally comprise at least one center rail as furniture rail, which is arranged on the at least one carcass rail and/or the at least one drawer rail, wherein the at least one center rail in this context can be regarded as belonging to the at least one carcass rail or the at least one drawer rail.

As stated at the beginning, protection is also sought for a method for producing at least one such drawer pull-out guide, wherein the following method steps are carried out:

- a flat, preferably metallic, particularly preferably steel, sheet with a longitudinal direction and two top surfaces is provided as a semifinished product of the at least one rail, preferably of the at least one carcass rail, of the at least one drawer rail and/or of the at least one possibly present center rail,
- the metal sheet is provided with at least one embossing on at least one top surface, preferably by at least one embossing die and/or at least one embossing roller, wherein the at least one embossing is arranged substantially orthogonal to the longitudinal direction,
- the metal sheet is bent, with the result that, in a cross section orthogonal to the longitudinal direction, a profile of the at least one rail is formed and the at least one embossing extends at least in areas over two lateral surfaces of the profile arranged substantially orthogonal to each other for reinforcing the profile, wherein the at least one embossing faces in the direction of an outer area of the at least one rail.

As stated at the beginning, protection is also sought for a method for producing at least one such drawer pull-out guide, wherein the following method steps are carried out:

- a flat, preferably metallic, particularly preferably steel, sheet with a longitudinal direction and two top surfaces is provided as a semifinished product of the at least one rail, preferably of the at least one carcass rail, of the at least one drawer rail and/or of the at least one possibly present center rail,
- the metal sheet is provided with at least one embossing on both top surfaces, preferably by at least one embossing die and/or at least one embossing roller, wherein the at least one embossing is arranged substantially orthogonal to the longitudinal direction,
- the metal sheet is bent, with the result that, in a cross section orthogonal to the longitudinal direction, a profile of the at least one rail is formed and the at least two embossings face in the direction of an inner area and in the direction of an outer area of the at least one rail in an alternating manner.

It is particularly advantageous if the embossings arranged relative to an inner area of the rail in an alternating manner extend across two lateral surfaces and/or are arranged relative to two adjoining and substantially orthogonally oriented lateral surfaces in an alternating manner.

In particular with respect to the demands on rails in the furniture industry or furniture sector, an introduction of embossings arranged relative to an inner area of a profile of the rail in an alternating manner is not insignificant, wherein two embossing dies—for example formed as notch dies—or two embossing rollers—for example, formed as notch rollers—particularly preferably provide both top surfaces with a profiling, preferably sequentially in one embossing process step or iteratively in a plurality of embossing process steps.

As the at least one center rail need not necessarily be provided in the case of the drawer pull-out guide according to the invention, the advantageous embodiments of the invention are directed towards the at least one compulsory carcass rail and/or the at least one compulsory drawer rail. However, the features of the advantageous embodiments of the drawer pull-out guide contingent on features associated with the at least one carcass rail and/or the at least one drawer rail—in particular those of the dependent claims—are to be applied in the same way to the at least one possibly present center rail.

According to an advantageous design of the invention, at least one carriage with at least one rolling body and/or sliding body is arranged or arrangeable on the drawer pull-out guide, wherein the at least one embossing is arranged on the at least one carcass rail and/or the at least one drawer rail in such a way that the at least one embossing is traversable contactlessly by the at least one carriage and/or the at least one rolling body and/or sliding body in the longitudinal direction.

A user-friendly guiding of the at least one drawer rail relative to the at least one carcass rail can thereby be guaranteed, wherein the at least one embossing does not interfere with the movement of the at least one carriage.

It is advantageously provided that the profile of the at least one carcass rail and/or of the at least one drawer rail has at least one fold with at least a double material thickness of the metal sheet on at least one longitudinal edge, preferably on two longitudinal edges.

Through the at least one fold, an increase in the section modulus of the rail can be obtained. For example, a rail with a material thickness of the metal sheet of 0.7 mm is locally increased to 1.5 mm, in order to be able to properly operate the same weight categories of furniture parts despite the smaller material thickness, or wherein at least the reduction in the weight category turns out to be smaller in relation to the weight reduction of the rail.

It has proved to be favorable that at least one lateral surface of the profile, on which at least one fold is arranged, is present in the form of a track for the linear movement of the at least one carriage along the longitudinal direction. Preferably, the at least one rolling body and/or sliding body is mobile at least in portions in the longitudinal direction along the at least one fold.

A particularly compact drawer pull-out guide is thereby possible, wherein a region of the rail strengthened by the at least one fold ensures particularly comfortable rolling and/or sliding characteristics of the at least one carriage without deforming the rail under load in an undesired manner.

According to an advantageous embodiment of the invention, in each case one fold is arranged on two longitudinal edges of the profile and one embossing is arranged on a lateral surface with a folded longitudinal edge and a further embossing is arranged on a lateral surface without folded longitudinal edge.

Through such an arrangement of folds and embossings, it can be guaranteed that an increase in stability is generated substantially across the entire profile, wherein specific regions are structurally adjusted individually with regard to strength.

It has proved to be advantageous to have at least one fold face in the direction of the inner area and at least one further fold face in the direction of the outer area of the at least one carcass rail and/or of the at least one drawer rail. Preferably, the at least one embossing is arranged on lateral surfaces of the at least one carcass rail and/or of the at least one drawer rail on which no fold is arranged.

It is thereby made possible that the at least one inward facing fold can be used as a track and the at least one outward facing fold does not restrict the movement of the at least one carriage, or a compact and lightweight rail is provided.

An advantageous variant is that the at least one fold comprises at least one reinforcing device, preferably precisely two, spaced apart from each other in the longitudinal direction and/or having a double material thickness of the metal sheet. Preferably, the at least one reinforcing device:

- is punched, and/or
- protrudes transversely from the at least one fold and/or comprises a bend, and/or
- is arranged parallel to the at least one fold at least in areas, and/or
- is arranged orthogonal to the at least one fold at least in areas.

A gaping of the profile under load is effectively counteracted by the at least one reinforcing device, with the result that a geometric fidelity is increased. In addition, the at least one reinforcing device increases the stability and/or strength properties of the rail.

The at least one reinforcing device can, in the sense of a dual function, additionally act as a device for connecting the at least one carcass rail and/or the at least one drawer rail to a furniture part, wherein particularly preferably one punching is oriented orthogonal to the lateral surface and a further punching is arranged parallel to the lateral surface due to a bend.

It is particularly preferred that at least one limit stop is arranged at least in areas on at least two substantially orthogonally arranged lateral surfaces of the at least one carcass rail and/or of the at least one drawer rail, wherein it is preferably provided that the at least one limit stop:

- is punched out of the profile projecting in the direction of the inner area of the at least one carcass rail and/or of the at least one drawer rail, and/or
- is connected in a material-bonding manner to the two lateral surfaces, and/or
- is arranged on a lateral surface on which possibly a fold is arranged and is arranged on a lateral surface on which possibly no fold is arranged.

Through the at least one limit stop, a sufficiently large contact surface for the at least one carriage can be generated that, even in the case of impact stresses of the at least one carriage, a lifetime of the at least one carriage is long. The at least one limit stop particularly preferably represents a corner of the profile projecting into the inner area of the profile, which corner defines a stable support for the at least one carriage by connection to two lateral surfaces.

In an embodiment of the invention, the at least one limit stop is arranged parallel to the at least one embossing with a lateral offset. Preferably, the at least one limit stop extends in the direction orthogonal to the longitudinal direction over a longitudinal edge and the at least one embossing extends over a further longitudinal edge of the at least one carcass rail and/or of the at least one drawer rail.

The at least one embossing and the at least one limit stop particularly preferably overlap in the direction orthogonal to the longitudinal direction, wherein one longitudinal edge, due to the at least one limit stop, has the function of limiting the at least one carriage and the further longitudinal edge, which is spatially separate from the longitudinal edge and on which the at least one embossing is arranged, has the function of particularly strongly reinforcing the profile. On the profile, the two longitudinal edges particularly preferably represent one longitudinal edge, which adjoin two lateral surfaces, wherein in particular two remaining longitudinal edges in each case adjoin only one lateral surface.

According to a preferred embodiment of the invention, the at least one embossing is arranged in an end area of the at least one carcass rail and/or of the at least one drawer rail relative to the longitudinal direction, wherein the at least one limit stop is possibly arranged between the end area and the at least one embossing.

As the end area is usually subjected to particularly high dynamic and/or static loads in an open position and/or a closed position of the drawer pull-out guide, a lifetime of the rail can be increased by locating the at least one embossing in the end area.

It is particularly preferable that the metal sheet has a material thickness in the range from 0.5 mm to 1.5 mm, preferably 0.6 mm to 0.8 mm.

In the state of the art, such small material thicknesses are associated with significant performance losses and/or lifetime losses during operation of the rail. According to the invention, however, small material thicknesses can also be used in the case of rails with high load requirements or heavy movable furniture parts.

It has proved to be favorable that at least one group of precisely three embossings for reinforcing the profile is arranged at least in areas on at least two substantially orthogonally arranged lateral surfaces of the at least one carcass rail and/or of the at least one drawer rail.

It has proved to be favorable if one group is arranged in an end area of the rail and a further group is arranged in a further end area of the rail, wherein the group can generally also be formed of two or more embossings.

Furthermore, preferably the at least two embossings are arranged on the same lateral surface or on the same lateral surfaces extending over at least two lateral surfaces and/or on the at least two lateral surfaces in an alternating manner. Preferably, the at least two embossings are arranged in a transition area of the at least two lateral surfaces in an alternating manner relative to the inner area and the outer area.

For example, embossings which are aligned into the inner area and outer area in an alternating manner can be arranged on one lateral surface. Alternatively or additionally, one of the embossings can extend across two lateral surfaces and/or an alternating arrangement of the embossings relative to the lateral surfaces can be provided, wherein two embossings arranged next to each other are oriented substantially orthogonal to each other.

In a further embodiment of the invention, at least, preferably in the case of possibly present groups precisely, two embossings face in the direction of the inner area of the at least one carcass rail and/or of the at least one drawer rail and one embossing is arranged in the middle between the at least two embossings and faces in the direction of the outer area of the at least one carcass rail and/or of the at least one drawer rail to increase a tensile/compressive strength.

A tensile/compressive strength of the rail is gradually increased by an increasing number of embossings. A rail withstands particularly large forces without plastic and/or improper elastic deformation due to alternating embossings and in particular due to an embossing oriented in the opposite direction (inner or outer area) in the middle between two embossings. In addition, the at least one embossing can serve as a support during installation of the drawer pull-out guide.

According to an advantageous design of the invention, the at least one embossing is formed pyramid-shaped or truncated-pyramid-shaped at least in the area of a lateral surface of the profile. Preferably, the at least one embossing comprises three substantially flat embossing surfaces and/or two embossing surfaces enclose an acute angle, particularly preferably of between 10° and 15°.

A widening of the at least one embossing in the direction of a transition area of lateral surfaces takes advantage of the fact that load maxima which occur during conventional operation of a rail are present in the transition area. An embossing widened in the transition area can particularly favorably compensate for force peaks. The at least one embossing particularly preferably extends into the transition area and/or across the transition area via an adjoining lateral surface.

According to an advantageous design of the invention, the at least one embossing extends in the orthogonal direction relative to the longitudinal direction of the at least one carcass rail and/or of the at least one drawer rail over an area of between one third and three quarters of the lateral surface and/or extends over an area of less than one third, preferably one quarter, of a lateral surface adjoining this lateral surface.

The at least one embossing can generally extend in the direction orthogonal to the longitudinal direction across an entire lateral surface, wherein such a structural design is generally not necessary due to lower loads on free longitudinal edges.

Advantageously, at least two embossings arranged in an alternating manner are provided and:

- at least one of the at least two embossings arranged in an alternating manner extends in the orthogonal direction relative to the longitudinal direction over an area of between one third and three quarters of the lateral surface and extends over an area of less than one third, preferably one quarter, of a lateral surface adjoining this lateral surface, and
- at least one other of the at least two embossings arranged in an alternating manner extends in the orthogonal direction relative to the longitudinal direction over an area of less than one third, preferably one quarter, of the lateral surface and extends over an area of at least three quarters of the lateral surface adjoining this lateral surface.

Through an alternating arrangement of embossings with respect to the lateral surfaces (not with respect to the inner area of the rail), an extent of the individual embossings with respect to a lateral surface can be reduced as both lateral surfaces are strengthened by embossings.

This can enhance an esthetic appearance and/or reduce manufacturing effort. The embossings particularly preferably end in a transition area of the lateral surfaces.

At least one of the embossings arranged in an alternating manner preferably extends substantially over an entire lateral surface, wherein at least one further embossing preferably extends across a lateral surface only in areas.

It has proved to be favorable that the at least one embossing extends substantially over an entire longitudinal extent, oriented orthogonal to the longitudinal direction, of the at least two lateral surfaces and/or the at least one embossing comprises two embossing surfaces arranged parallel to each other.

A reinforcement of the profile which advantageously acts over four lateral surfaces of the profile can be generated thereby.

According to an advantageous embodiment of the invention, the profile comprises a step on at least one lateral surface, wherein the at least one embossing extends across the step of the profile.

Through the at least one step, an additional reinforcement is generated in the profile, wherein for example a fastening side can be particularly favorably brought to rest flat against a furniture part and/or a fastening surface can be spaced apart from the furniture part in the area of fastening means for the positionally stable positioning on a furniture part.

An advantageous variant is that the at least one carcass rail and/or the at least one drawer rail has at least one fastening portion with a fastening side which, during installation on the furniture carcass or at least one furniture part, can be brought to rest against the furniture carcass or the at least one furniture part at least in portions. The at least one fastening portion has at least one, preferably circular, opening for a fastening means, preferably a screw, to pass through. The at least one opening, on a second side spaced apart from the fastening side by a material thickness of the fastening portion, preferably of between 0.5 mm and 1.5 mm, particularly preferably between 0.6 mm and 0.8 mm, is surrounded by a ridge which protrudes transversely from the second side.

In other words, the opening, on the side of the fastening portion facing a screwhead, is surrounded by a, preferably annular, ridge, which is provided for receiving the screwhead at least in areas. The screwhead is therefore at least partially, preferably substantially completely, countersinkable inside the ridge.

The peripheral rim of the opening is also strengthened by the ridge, i.e. the force emanating from the underside of the screwhead can be distributed over a larger surface area. The extent to which the screwhead sinks into the thin-walled metal of the fastening portion can be minimized by the ridge. The risk of damage to the peripheral rim of the opening can therefore be reduced in this way.

If the ridge is, for example, produced in the form of an embossing, then a corresponding recess is formed on the fastening side of the fastening portion, in which recess the chip material coming out of the furniture part can be at least partially received. As a result, the risk of the chip material getting in between the fastening side of the fastening portion and the furniture part and thus leading to an undesired spacing of the fastening portion from the furniture part is also reduced.

It is particularly preferred that the at least one carcass rail and/or the at least one drawer rail has at least two substantially orthogonally arranged lateral surfaces. The at least two embossings are arranged on the lateral surfaces in such a way that the at least two embossings are arranged:

adjoining each other in the longitudinal direction, and/or
on the same lateral surface or the same lateral surfaces, and/or
on the at least two lateral surfaces in an alternating manner, and/or
in a transition area of the at least two lateral surfaces in an alternating manner.

If, for example, the embossings are arranged in the direction of the inner area and of the outer area of the rail in an alternating manner in a transition area of the at least two lateral surfaces, then a particularly strengthened longitudinal edge is brought about, wherein the strengthening acts in the direction of the adjacent longitudinal edges over the lateral surfaces in the direction orthogonal to the longitudinal direction and/or in the longitudinal direction.

BRIEF DESCRIPTION OF THE DRAWINGS

Further details and advantages of the present invention are explained in more detail below via the description of the figures with reference to the embodiments represented in the drawings, in which.

DETAILED DESCRIPTION OF THE INVENTION

Figure 1A:
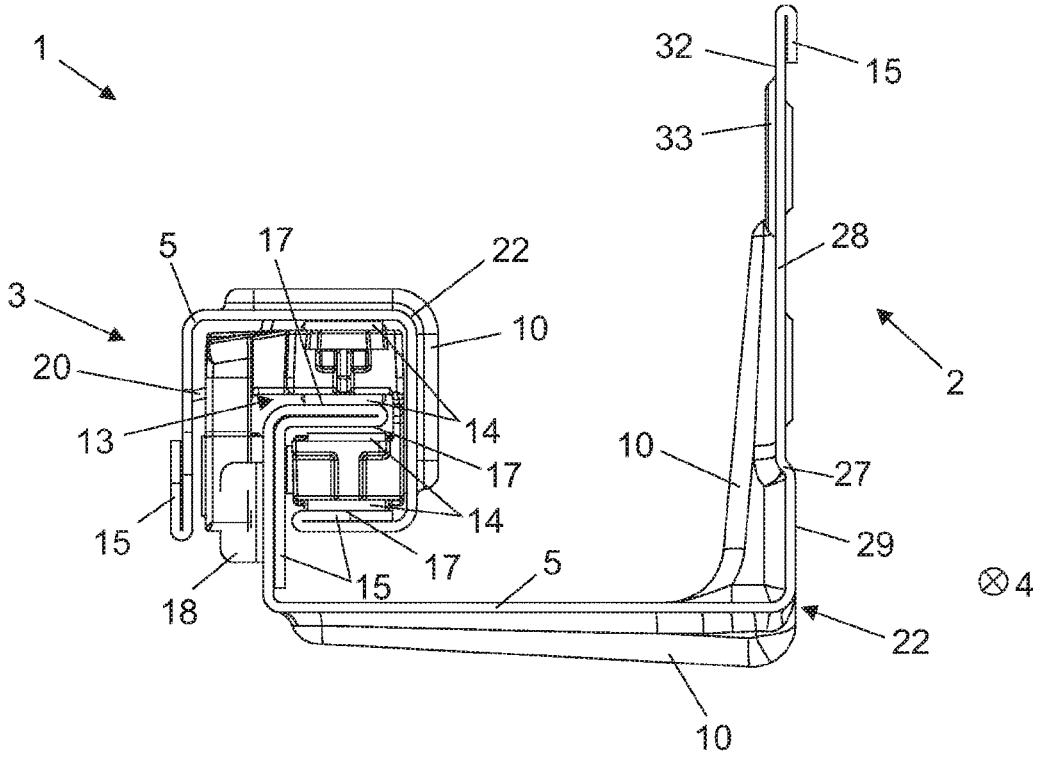
FIGS. 1*a*-1*b* show a drawer pull-out guide according to a particularly preferred embodiment in a view from the front with a carriage arranged between a carcass rail and a drawer rail and without the carriage.

FIG. 1 shows a drawer pull-out guide 1 for movably mounting a drawer on a furniture carcass (the furniture parts are not visible in the representations for reasons of clarity), comprising, as rails, a carcass rail 2 to be fastened to the furniture carcass and a drawer rail 3 to be connected to the drawer, which drawer rail is mounted displaceable relative to the carcass rail 2 in a longitudinal direction 4. A center rail can generally also be arranged between the carcass rail 2 and the drawer rail 3, wherein this is not compulsory.

A carriage 13 with rolling bodies 14—wherein the carriage 13 can, alternatively or additionally, generally also comprise sliding bodies—is arranged on the carcass rail 2 and the drawer rail 3 of the drawer pull-out guide 1.

The carcass rail 2 and the drawer rail 3 have, in a cross section 5 normal to the longitudinal direction 4, a profile 9 formed from a flat metal sheet 6 with two longitudinal edges 7 running parallel to each other.

An embossing 10 extending over two lateral surfaces 8 of the profile 9 arranged orthogonal to each other is arranged on the drawer rail 3 for reinforcing the profile 9 of the drawer rail 3, wherein the lateral surfaces 8 are arranged in the longitudinal direction 4 and the embossing 10 is arranged orthogonal to the longitudinal direction 4. Such an embossing 10 can generally also be arranged on the carcass rail 2.

The embossing 10 of the drawer rail 3 and the embossings 10 of the carcass rail (see FIG. 2*a*) are arranged on the drawer pull-out guide 1 in such a way that the embossings 10 are traversable contactlessly by the carriage 13 and the rolling bodies 14 in the longitudinal direction 4.

Figure 1B:
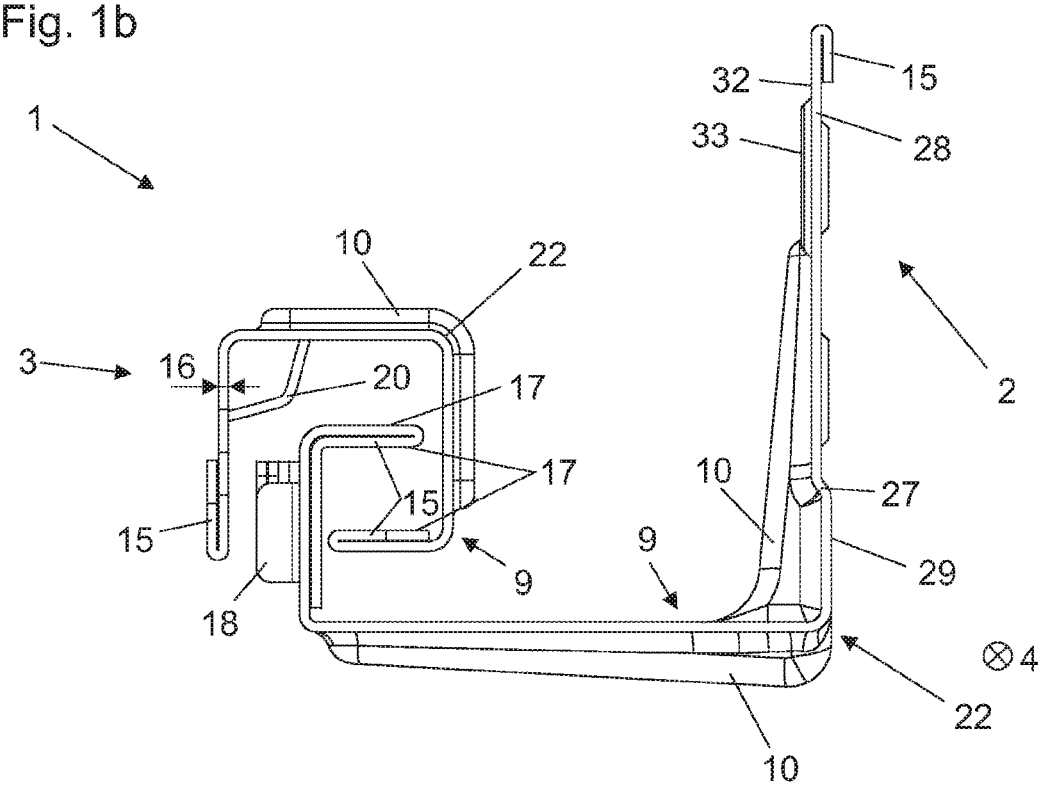

FIG. 1*b* differs from FIG. 1*a* only in that the carriage 13 has been removed for representational purposes; it is generally arranged on the drawer pull-out guide 1.

The metal sheet 6 of the carcass rail 2 and of the drawer rail 3 has a material thickness 16 in the region of 0.7 mm, wherein an increased stability of the drawer pull-out guide 1 is generated by the embossings 10.

Figure 2A:
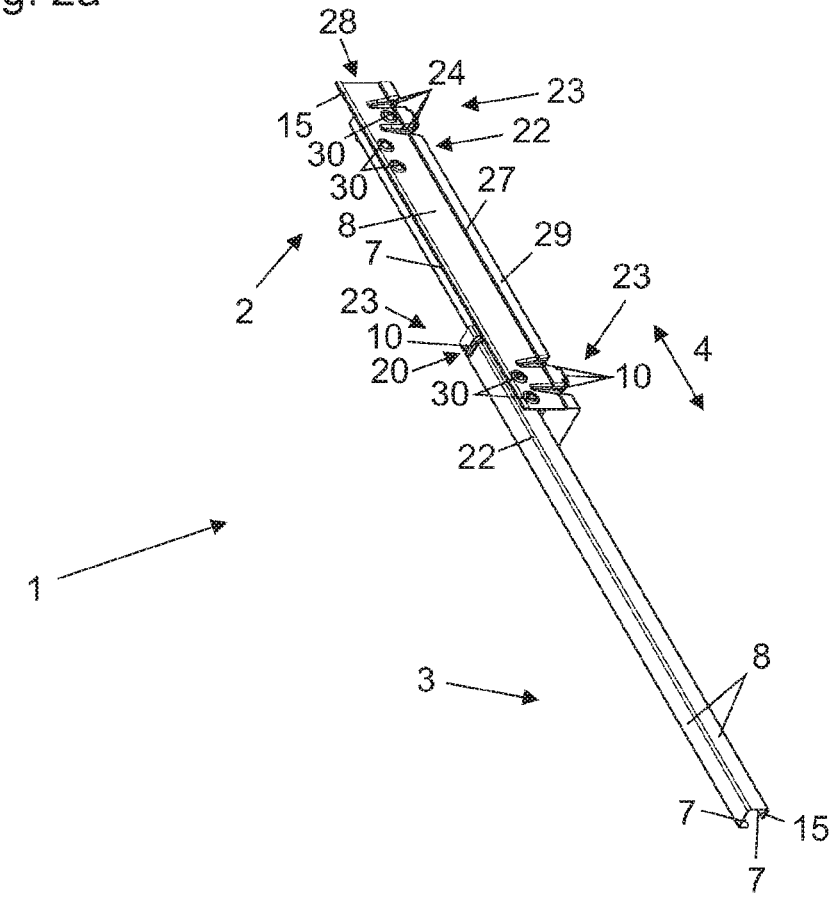
FIGS. 2*a*-2*b* show the drawer pull-out guide according to the embodiment according to FIG. 1*b* in a perspective representation.

FIG. 2*a* shows the drawer pull-out guide 1 at an altered angle of view, wherein the drawer rail 3 has been moved in the longitudinal direction 4 starting from a closed position in the direction of the open position of a movable furniture part.

The carcass rail 2 has two groups 21 of in each case three embossings 10 for reinforcing the profile 9, which are arranged on two orthogonally arranged lateral surfaces 8 of the carcass rail 2. The number of groups 21 and number of embossings 10 per group is generally as desired. The groups 21 are spaced apart from each other in the longitudinal direction 4 and arranged in an end area 23 of the carcass rail 2.

Figure 2B:
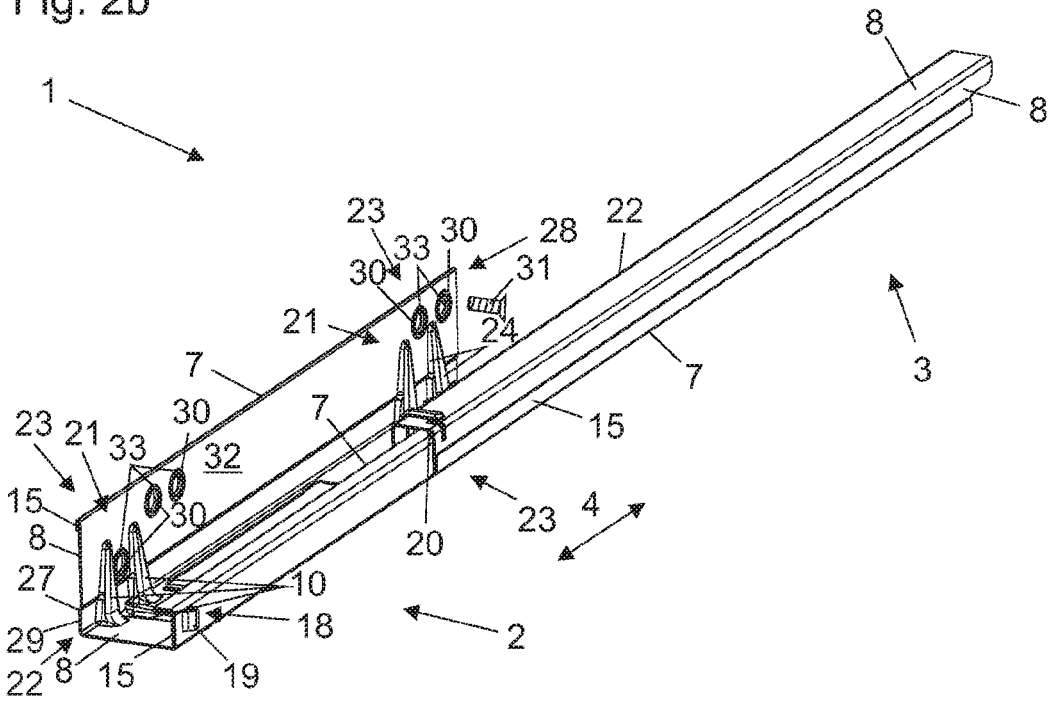

FIG. 2*b* shows the drawer pull-out guide 1 in an altered direction of view, wherein it can be seen that the three embossings 10 of a group 21 are arranged on two lateral surfaces 8 oriented orthogonal to and adjoining each other. Such embossings 10 can generally also be arranged on the drawer rail 3.

The embossings 10 of one lateral surface 8 extend into a transition area 22 and project into the adjoining lateral surface 8, wherein the embossings 10 can generally also end in the transition area 22 before entering the adjoining lateral surface 8.

Two embossings 10 of a group 21 are arranged on the same lateral surface 8, wherein the three embossings 10 of the group 21 are arranged on the two lateral surfaces 8 in an alternating manner, with the result that the embossings 10 are arranged in the transition area 22 of the at least two lateral surfaces 8 and in an alternating manner relative to the inner area 11 and the outer area 12. The embossings of a group 21 adjoin each other in the longitudinal direction 4.

Figure 3A:
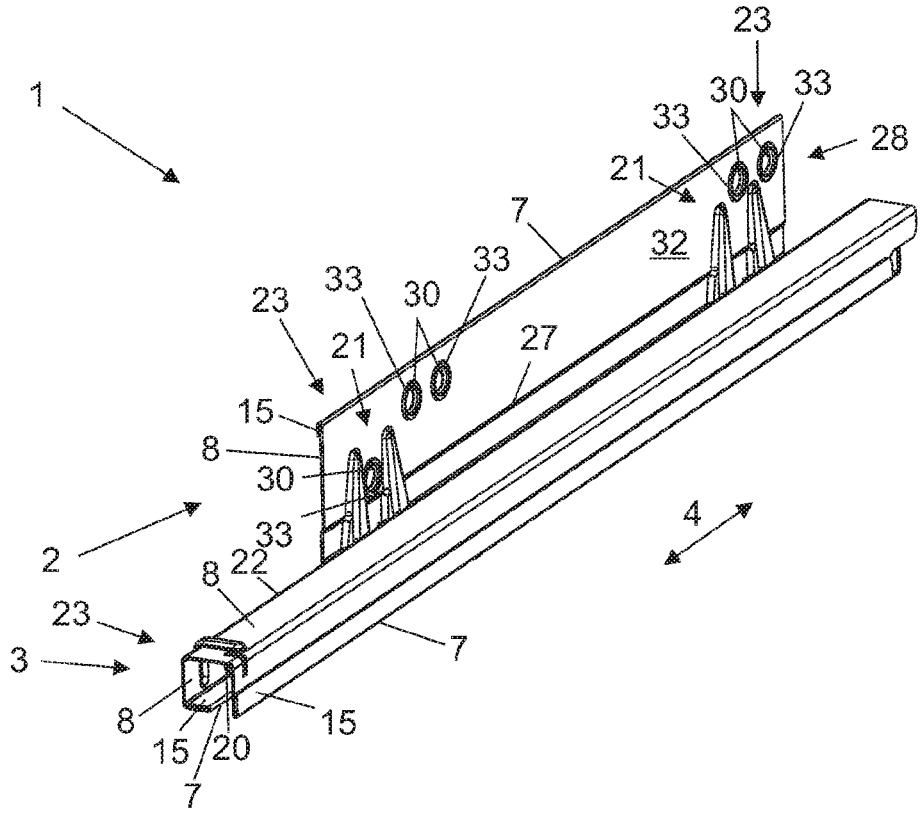
FIGS. 3*a*-3*b* show the drawer pull-out guide according to the embodiment according to FIG. 1*b* in a perspective view.
Figure 3B:
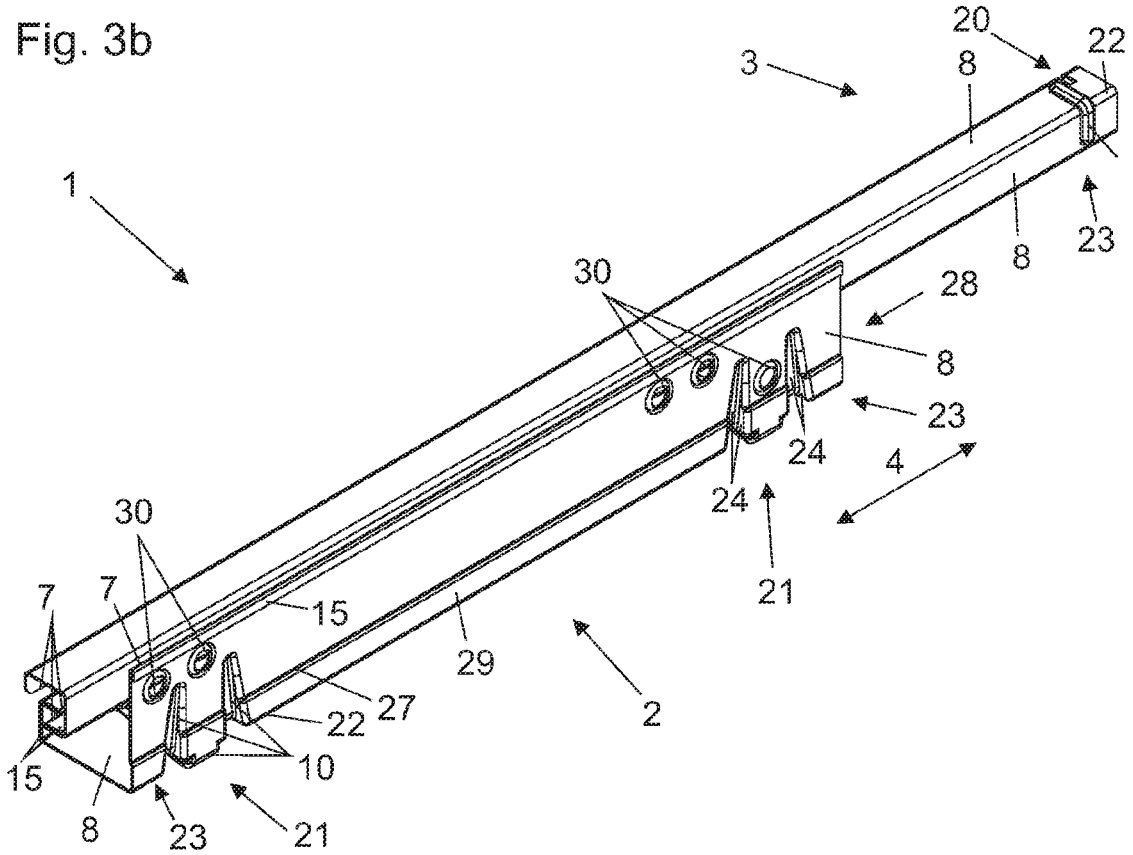

FIGS. 3*a* and 3*b* show, in associated perspective representations of the drawer pull-out guide, that the profile 9 of the carcass rail 2 and of the drawer rail 3 in each case has a fold 15 with a double material thickness 16 of the metal sheet 6 on two longitudinal edges 7 (cf. FIG. 1*b*).

A lateral surface 8 of the profile 9 of the carcass rail 2 and a lateral surface 8 of the profile 9 of the drawer rail 3, on which a fold 15 is arranged, is used in the form of a track 17 for the linear movement of the carriage 13 along the longitudinal direction 4, wherein only the carcass rail 2 or the drawer rail 3 can generally also comprise a folded track 17. The rolling bodies 14 are mobile in portions in the longitudinal direction 4 along the fold 15.

Figure 4A:
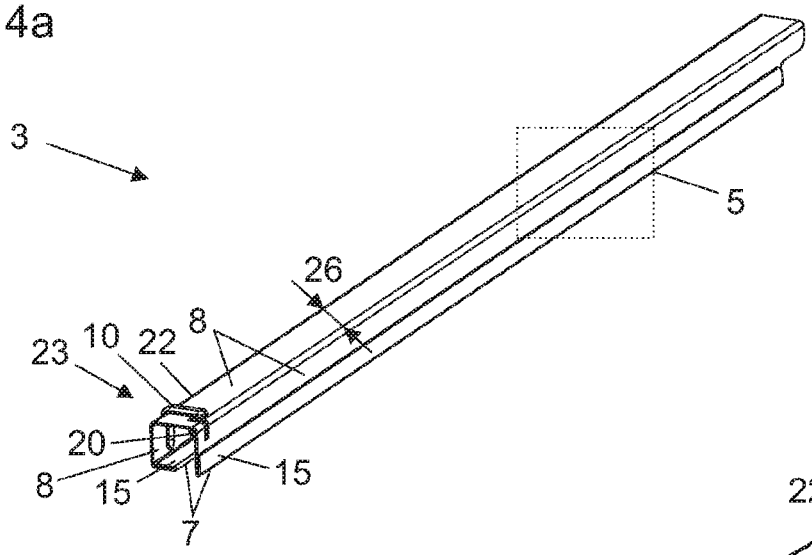
FIGS. 4*a*-4*c* show a drawer rail according to a particularly preferred embodiment of a drawer pull-out guide in perspective view and a top view with sectional representation.

FIG. 4*a* shows the drawer rail 3 of the drawer pull-out guide in isolation, wherein one fold 15 faces in the direction of the inner area 11 and a further fold 15 faces in the direction of the outer area 12 of the drawer rail 3. The embossing 10 is arranged on lateral surfaces 8 of the drawer rail 3 on which no fold 15 is arranged.

Figure 4B:
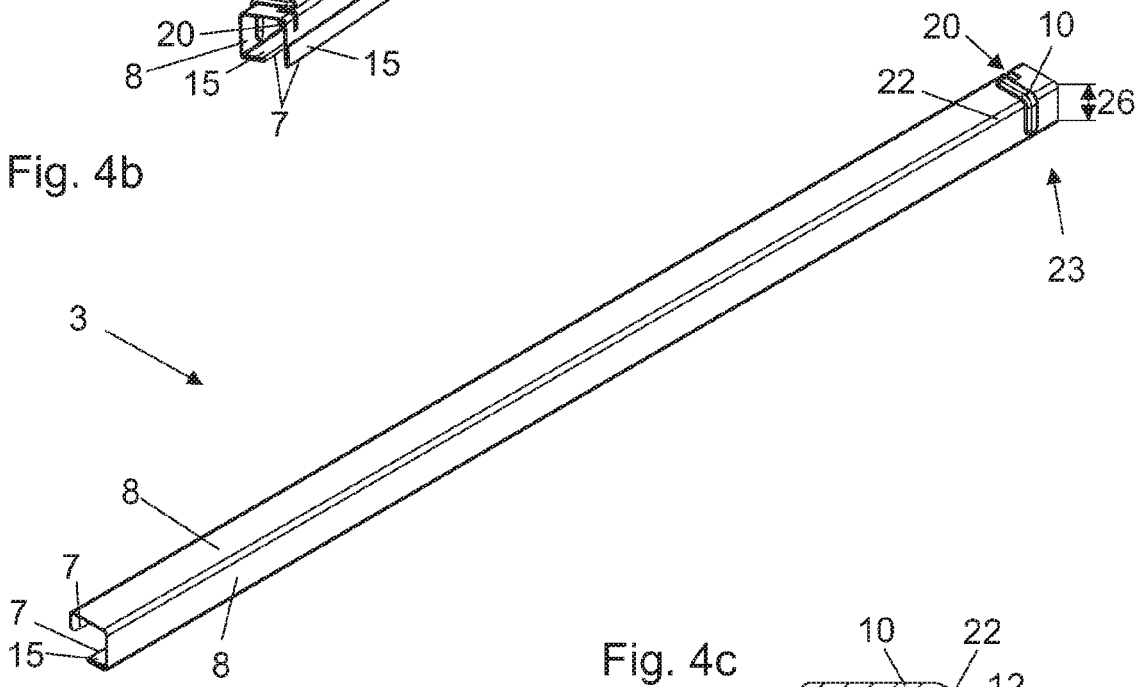

FIG. 4*b* differs from FIG. 4*a* only through an altered direction of view onto the drawer rail 3.

Figure 4C:
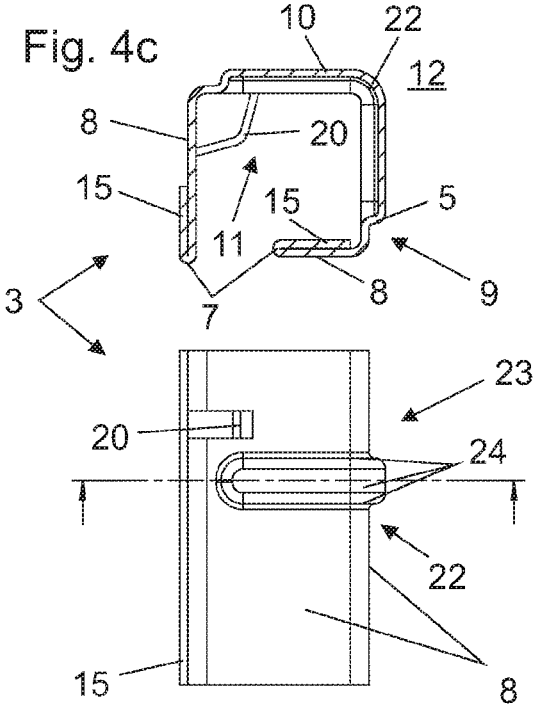

FIG. 4*c* shows the end area 23 of the drawer rail 3 with a sectional representation through the embossing 10, wherein a limit stop 20 is arranged on two orthogonally arranged lateral surfaces 8 of the drawer rail 3 in areas. The limit stop 20 is punched out of the profile 9 projecting in the direction of the inner area 11 of the drawer rail 3 and connected in a material-bonding manner to the two lateral surfaces 8. The limit stop 20 is arranged on a lateral surface 8 on which a fold 15 is arranged and is arranged on a lateral surface 8 on which no fold 15 is arranged.

The embossing 10 extends over an entire longitudinal extent 26, oriented orthogonal to the longitudinal direction 4, of the lateral surfaces 8 and the embossing 10 comprises two embossing surfaces 24 arranged parallel to each other.

Figure 5A:
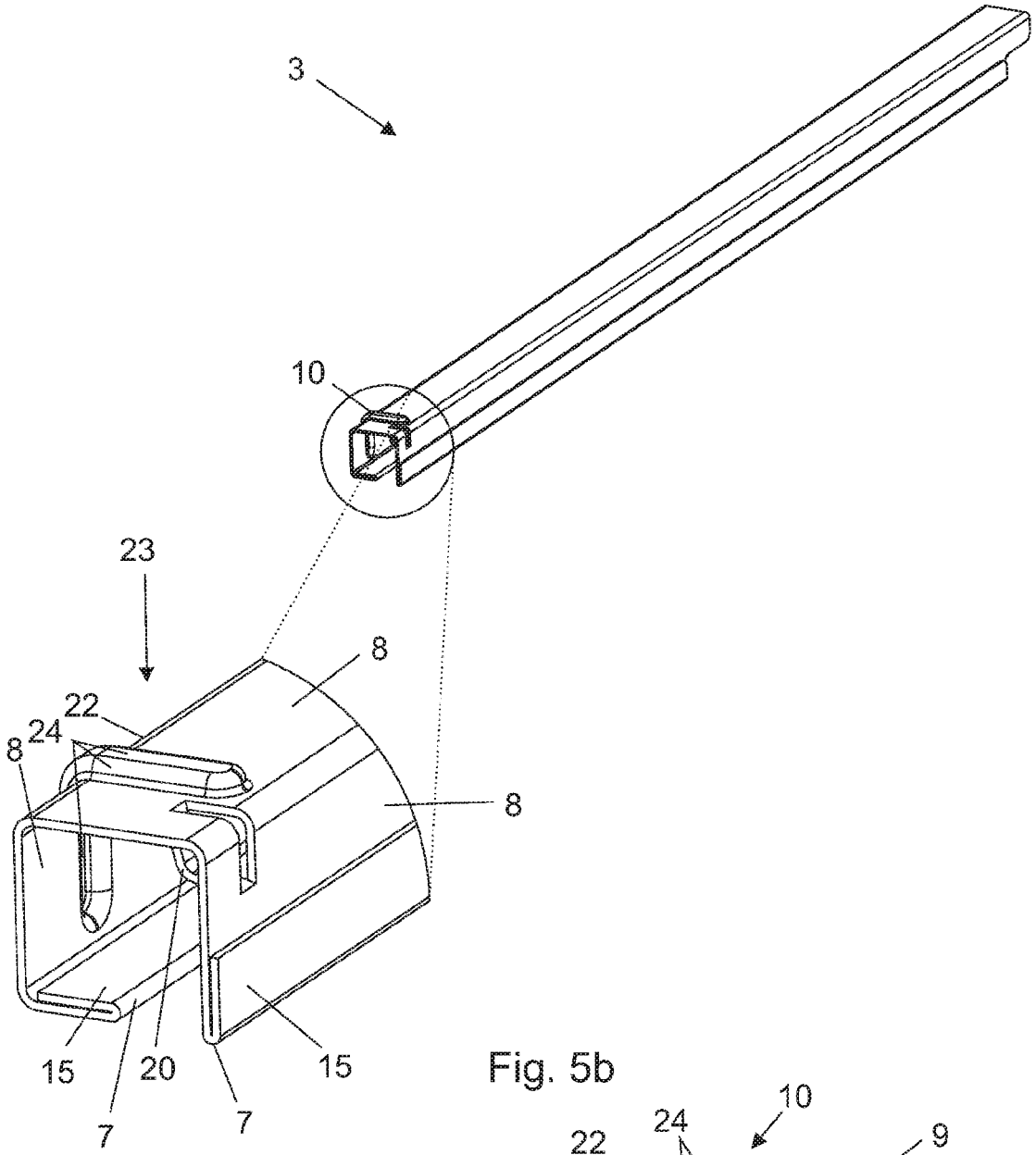
FIGS. 5*a*-5*b* show the drawer rail according to the embodiment according to FIG. 4*a* in a perspective view with an enlarged detail section of an end area of the profile and a view from the front.

FIG. 5*a* shows the drawer rail 3, wherein in the enlarged detail section it can be seen that the limit stop 20 is arranged parallel to the embossing 10 with a lateral offset. The limit stop 20 extends in the direction orthogonal to the longitudinal direction 4 over a longitudinal edge 7 and the embossing 10 extends over a further longitudinal edge 7 of the drawer rail 3. The limit stop and the embossing 10 are arranged overlapping on a lateral surface 8, wherein this is not compulsory.

The embossing 10 is arranged in the end area 23 of the drawer rail 3 relative to the longitudinal direction 4, wherein the limit stop 20 is arranged between the end area 23 and the embossing 10.

Figure 5B:
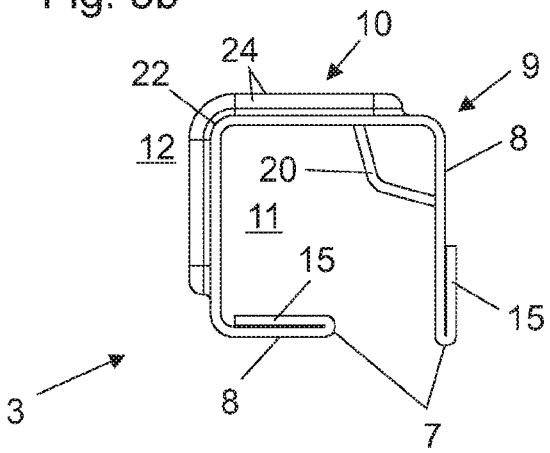

FIG. 5*b* shows the drawer rail 3 from the front, wherein the carriage 13 can be arranged in the inner area 11 in areas.

Figure 6A:
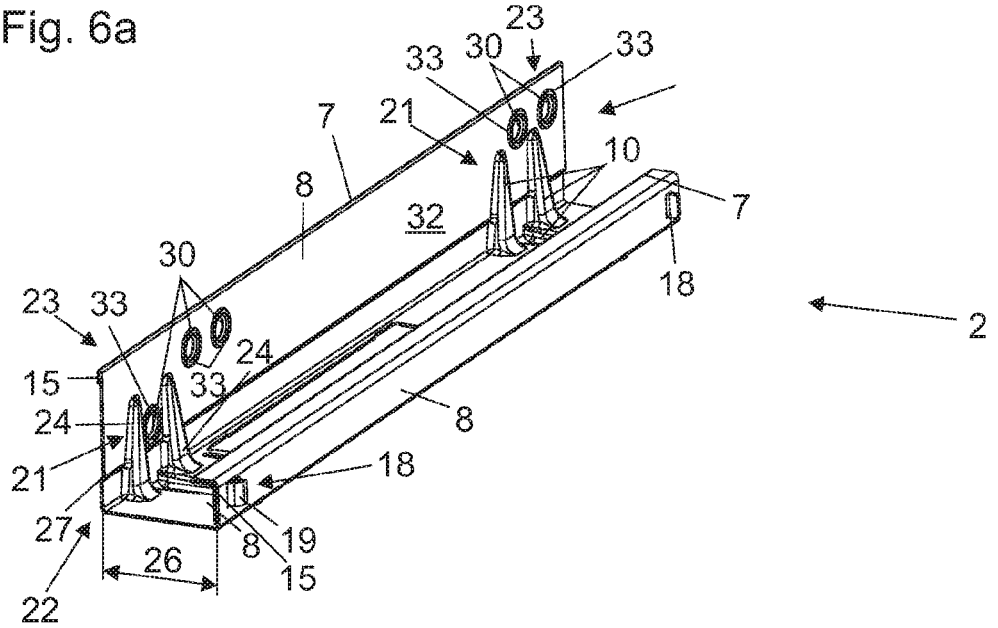
FIGS. 6*a*-6*b* show a carcass rail according to a particularly preferred embodiment of a drawer pull-out guide in perspective view with an enlarged detail section of an end area of the profile.

FIG. 6*a* shows the carcass rail 2 of the drawer pull-out guide 1 in isolation, wherein in each case one fold 15 is arranged on two longitudinal edges 7 of the profile 9 and one embossing 10 is arranged on a lateral surface 8 with a folded longitudinal edge 7 and a further embossing 10 is arranged on a lateral surface 8 without folded longitudinal edge 7.

One fold 15 of the carcass rail 2 has two reinforcing devices 18 spaced apart from each other in the longitudinal direction 4 and having a double material thickness 16 of the metal sheet 6, wherein both reinforcing devices 18 are punched and protrude transversely from the fold 15. A reinforcing device 18 comprises a bend 19 and is arranged parallel to the fold 15 in areas, wherein the further reinforcing device 18 is arranged orthogonal to the fold 15. The reinforcing devices 18 generate a profile fidelity by preventing the profile 9 from gaping and can act as a connection to a furniture part.

Figure 6B:
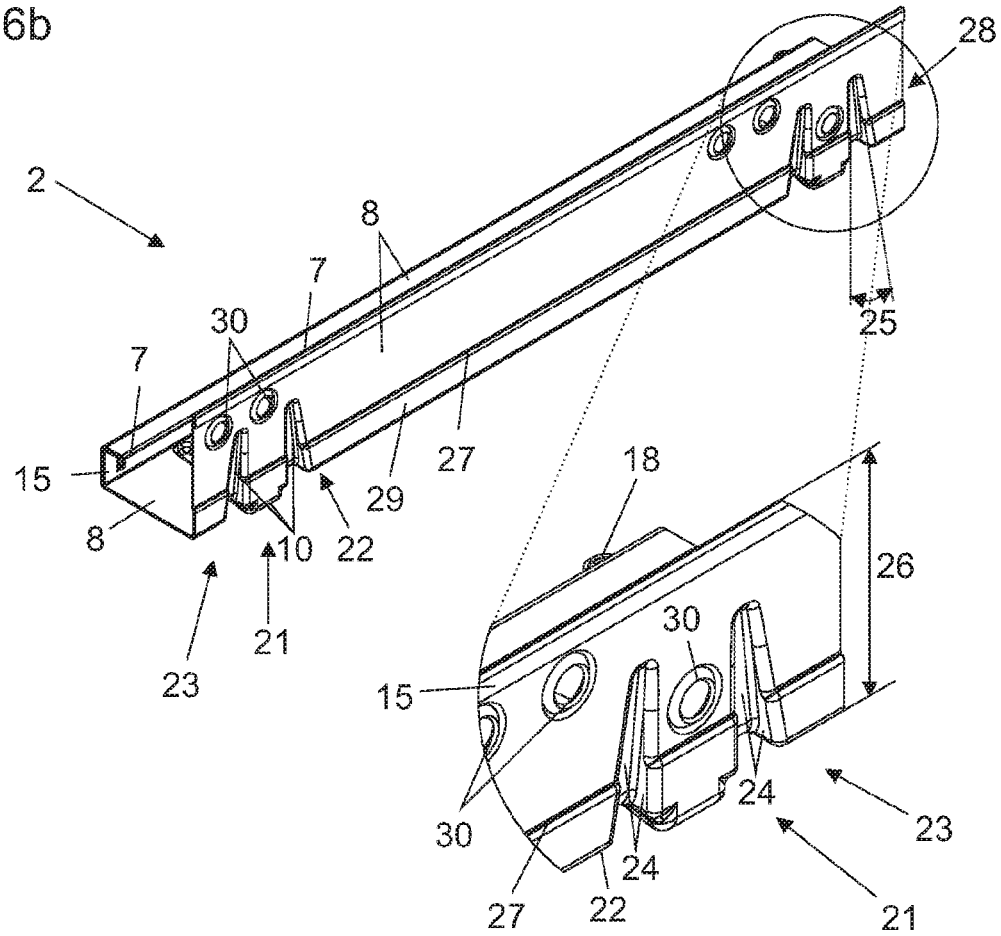

FIG. 6*b* shows that, in the area of a lateral surface 8 of the profile 9, the embossings 10 of the carcass rail 2 are formed pyramid-shaped with curvatures due to manufacturing techniques between embossing surfaces 24. The embossings 10 comprise three flat embossing surfaces 24, wherein in each case two embossing surfaces 24 enclose an acute angle 25 of 12°, wherein the angle 25 can also turn out to be larger or smaller, in order to maintain the functionality of the embossing 10.

Figure 7A:
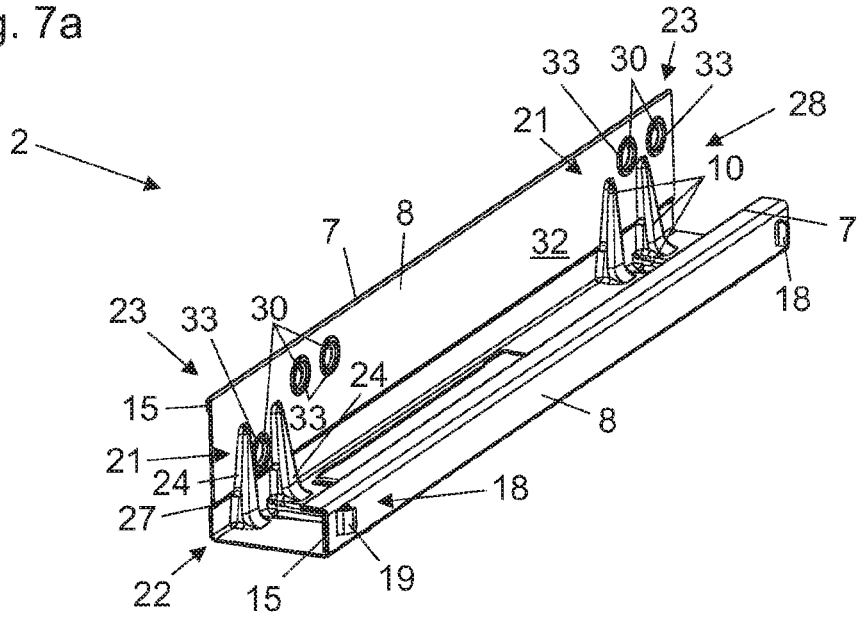
FIGS. 7*a*-7*b* show the carcass rail according to the embodiment according to FIG. 6*a* in perspective representation and a view from the side with a sectional representation and an enlarged detail section of the cross section.

FIG. 7*a* shows that on the carcass rail 2, in each group 21 of the two groups 21, in each case two embossings 10 face in the direction of the inner area 11 of the carcass rail 2 and one embossing 10 is arranged in the middle between the two embossings 10 and faces in the direction of the outer area 12 of the carcass rail 2 to increase a tensile/compressive strength.

Figure 7B:
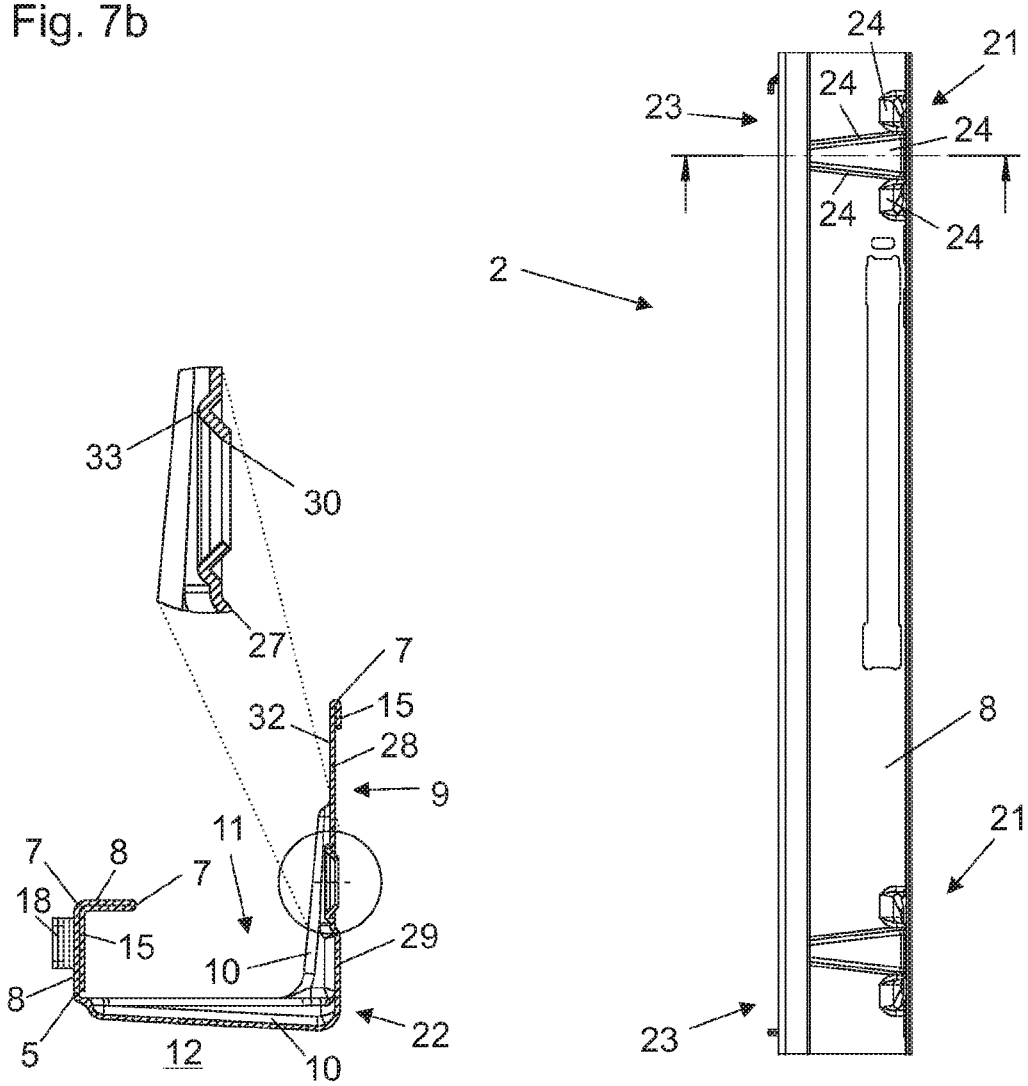

FIG. 7*b* shows, in the sectional representation through an embossing 10, that the embossing 10 extends in the orthogonal direction relative to the longitudinal direction 4 of the carcass rail 2 over an area of between one third and three quarters of the lateral surface 8 and/or extends over an area of less than one quarter of a lateral surface 8 adjoining this lateral surface 8. The embossing 10 which faces into the outer area 12 of the carcass rail 12, by contrast, extends over the entire lateral surface 8 and ends in both transition areas 22 with respect to the lateral surfaces 8 adjoining them.

Figure 8A:
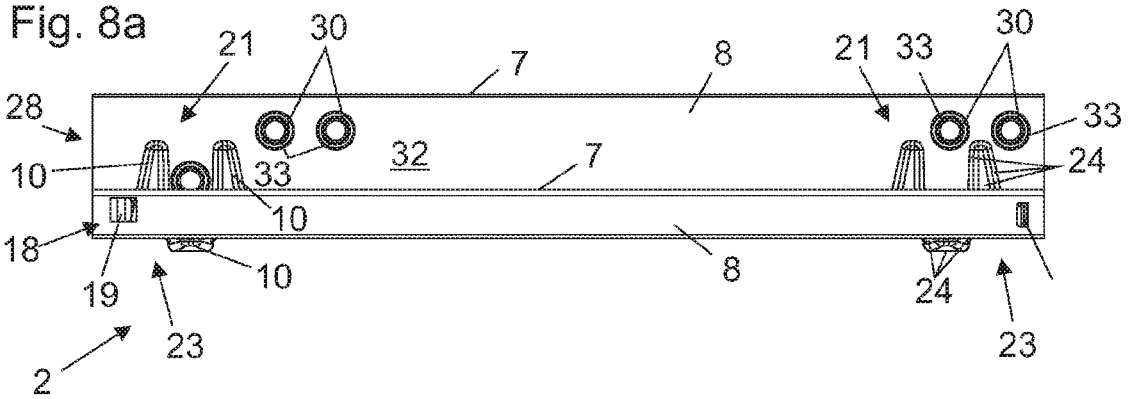
FIGS. 8*a*-8*b* show the carcass rail according to the embodiment according to FIG. 6*a* in a view from the side and two orthogonal side views with a sectional representation and an enlarged detail section.

FIG. 8*a* shows the embossings 10 of the carcass rail facing inwards and outwards in an alternating manner in a side view.

Figure 8B:
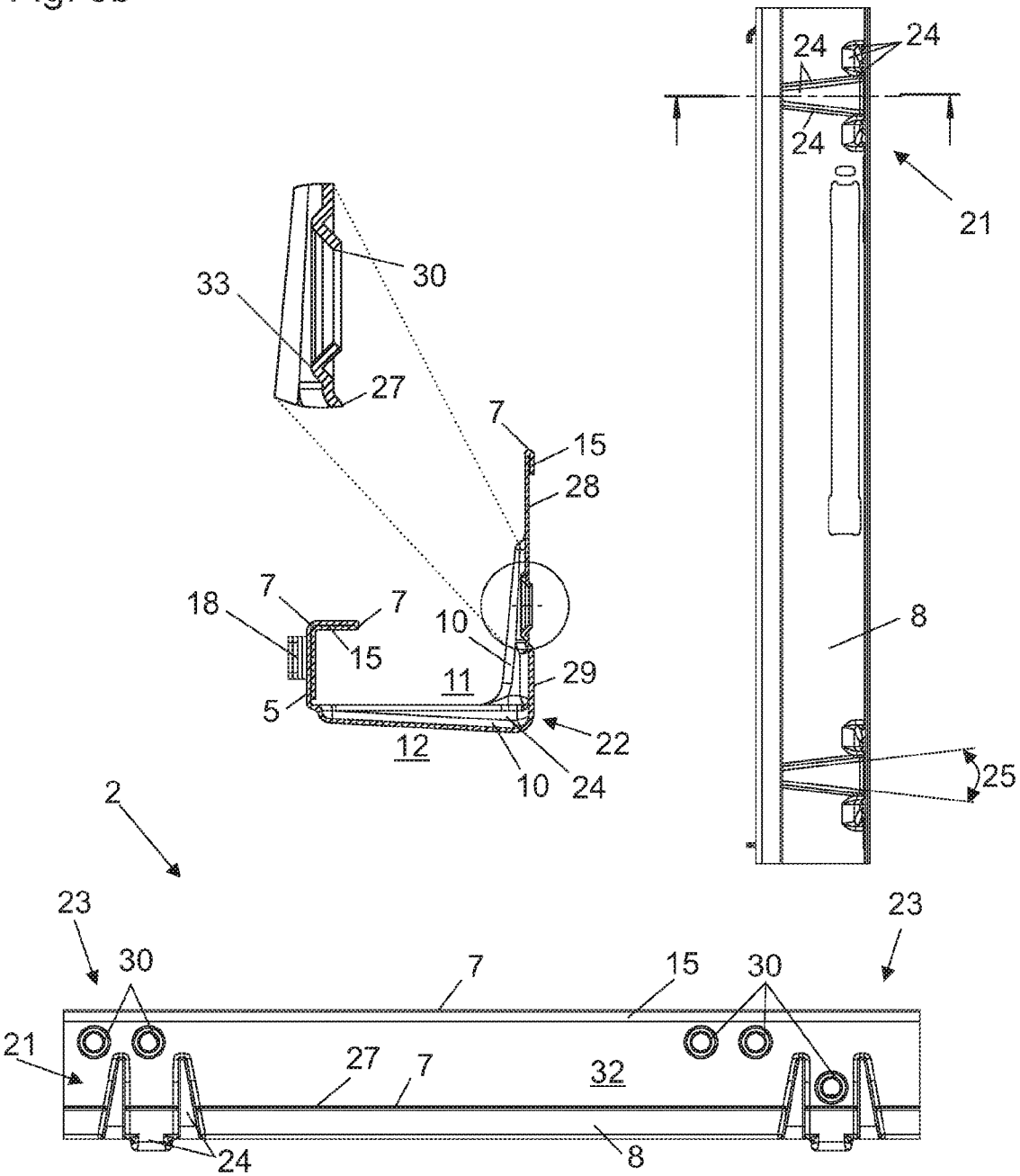

FIG. 8*b* shows that the profile 9 of the carcass rail 2 comprises a step 27 on a lateral surface 8, wherein embossings 10 extend across the step 27 of the profile 9.

Figure 9A:
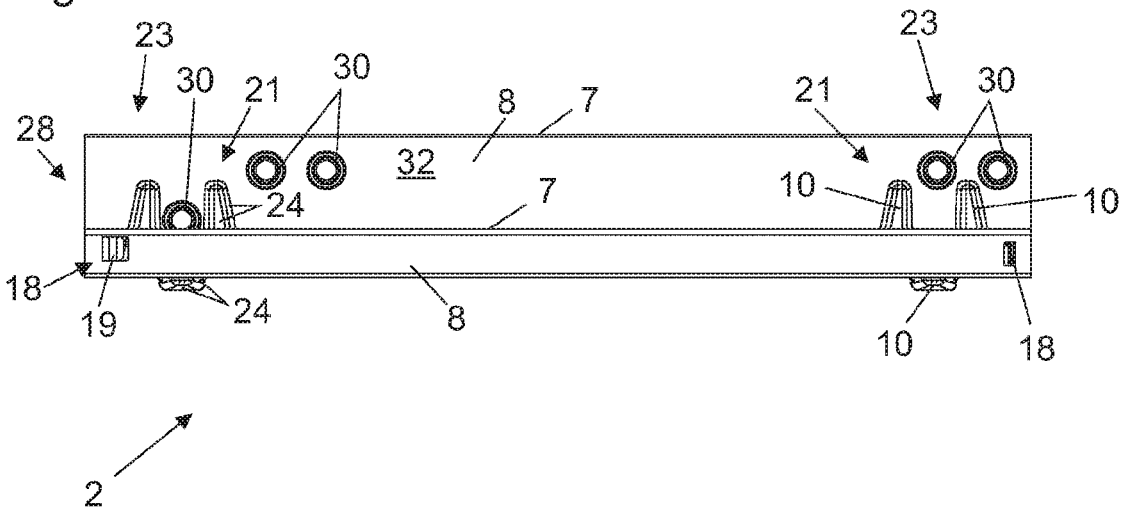
FIGS. 9*a*-9*b* show the carcass rail according to the embodiment according to FIG. 6*a* in two side views and a sectional representation of the profile, FIG. 10 show the carcass rail according to the embodiment according to FIG. 6*a* in perspective view with an enlarged detail section of a reinforcing device and a fold.
Figure 9B:
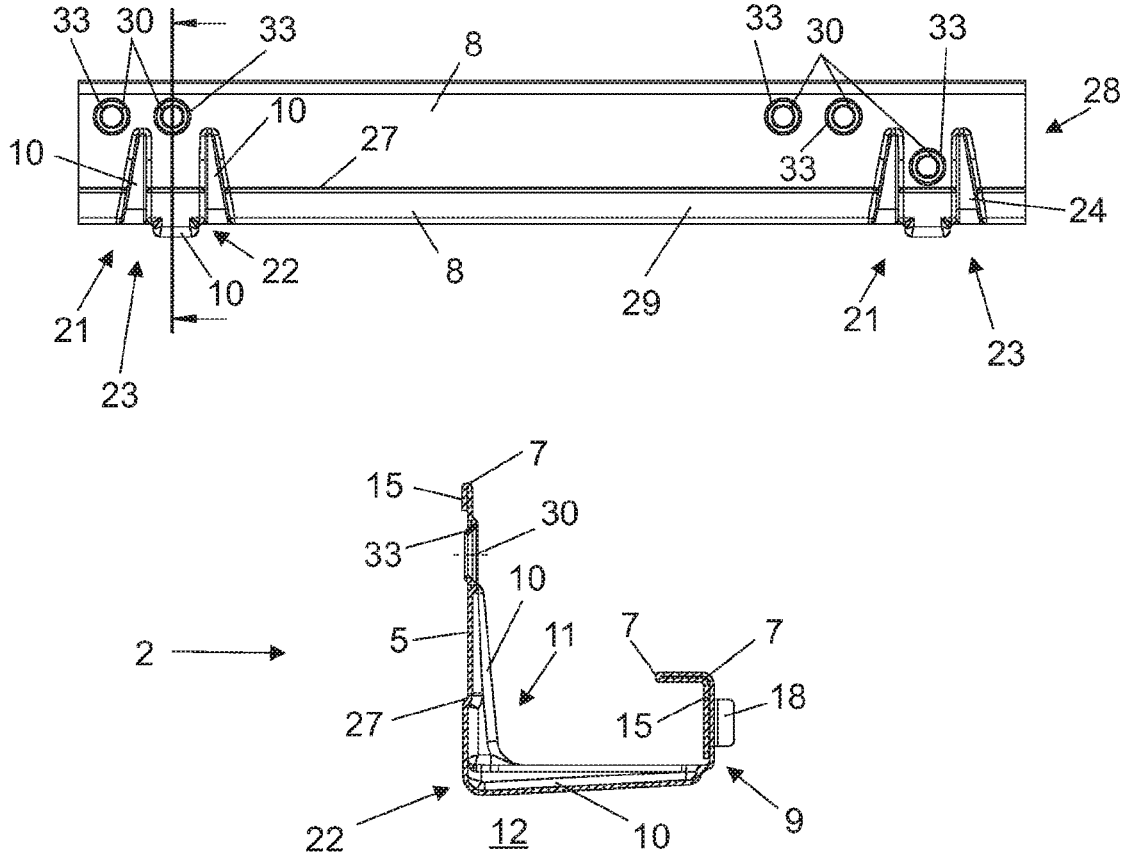

FIGS. 9*a* and 9*b* show that the carcass rail 2 has a fastening portion 28 with a fastening side 29 which, during installation on the furniture carcass or a furniture part, can be brought to rest against the furniture carcass or the furniture part in portions. The fastening portion 28 comprises a plurality of circular openings 30 for a fastening means 31 for example in the form of a screw—to pass through (cf. FIG. 2*b*).

On a second side 32 spaced apart from the fastening side 29 by a material thickness 16 of the fastening portion 28 of 0.7 mm—which can generally differ from a material thickness 16 of the metal sheet 6 locally—the openings 30 are surrounded by a ridge 33. The ridges 33 protrude transversely from the second side 32.

Figure 10:
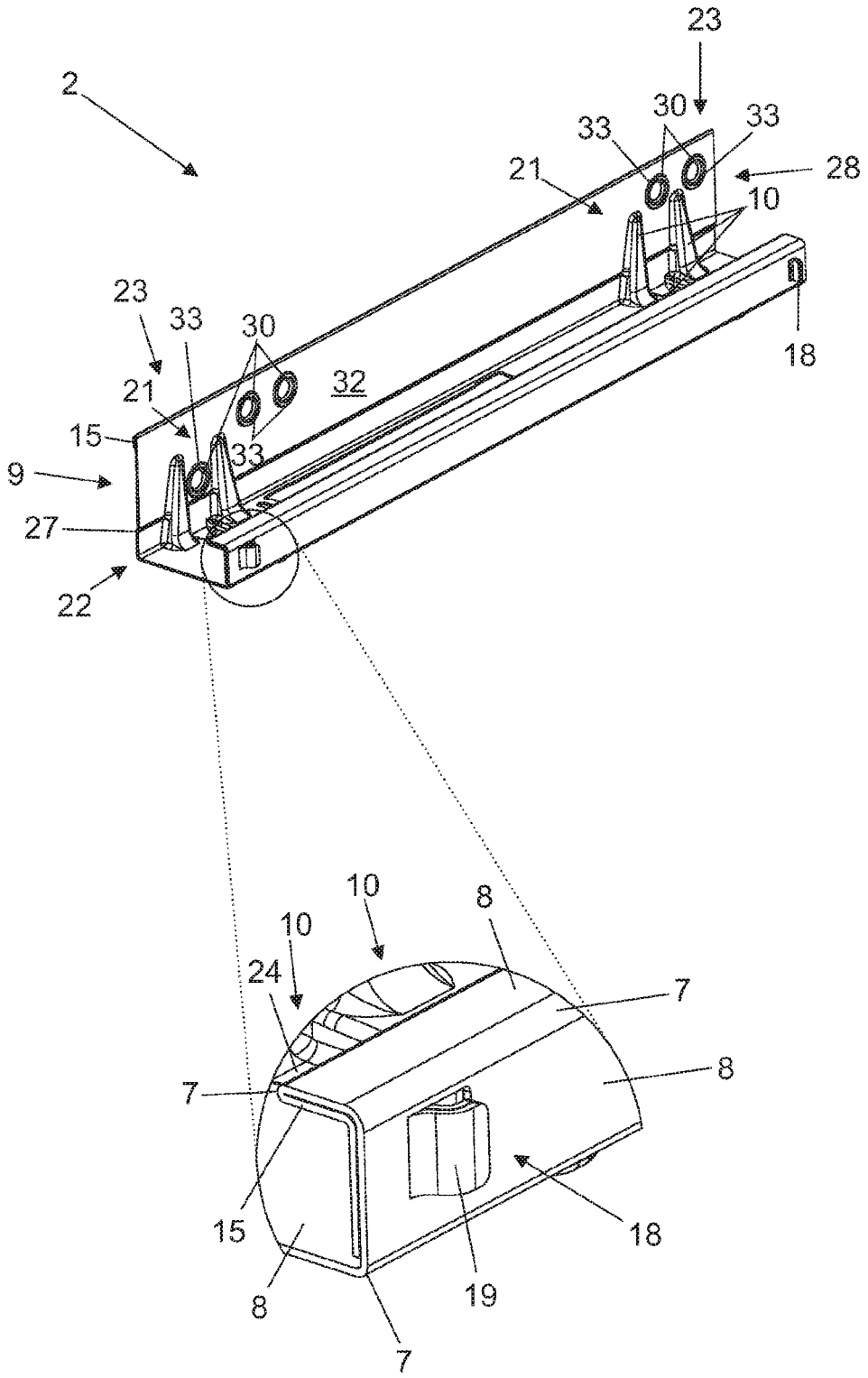

FIG. 10 illustrates, in the detail section, that the reinforcing devices 18 penetrate the double material thickness 16 of the fold 15.

Figure 11A:
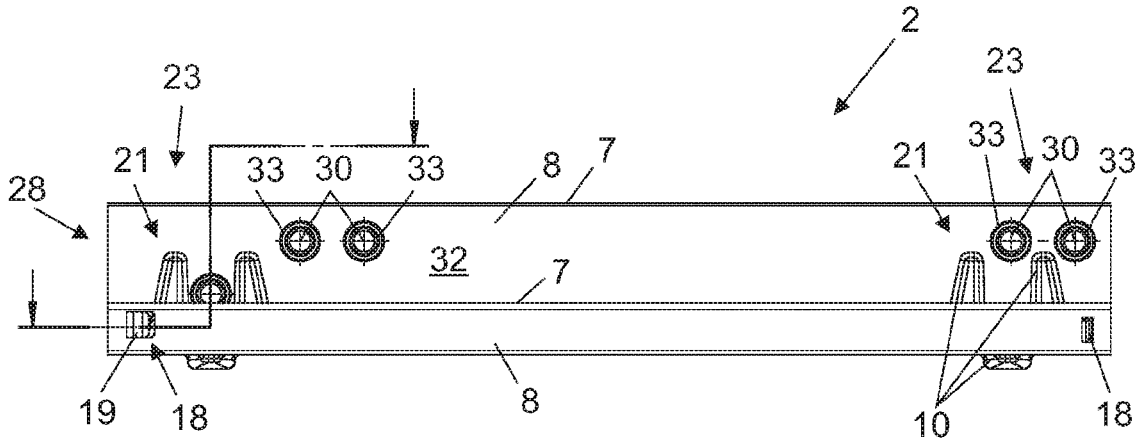
FIGS. 11*a*-11*b* show the carcass rail according to the embodiment according to FIG. 6*a* in two views from the side with an enlarged detail section of the reinforcing device.
Figure 11B:
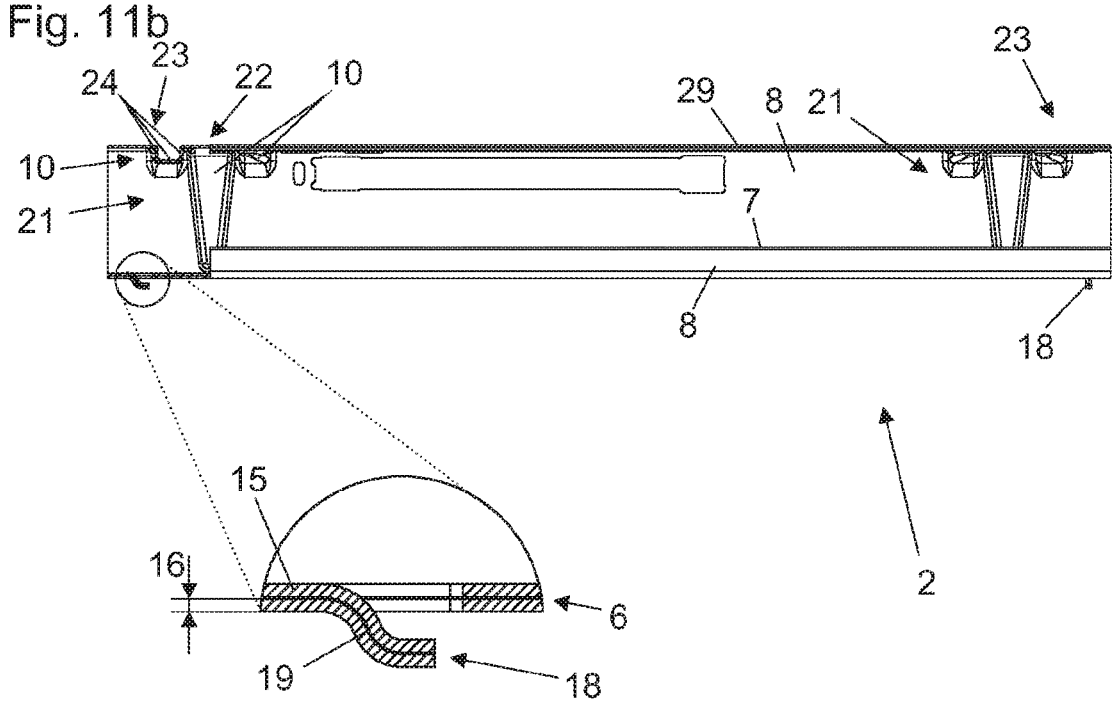

FIG. 11*a* and FIG. 11*b* show the embossings 10 of the carcass rail in two orthogonal views from the side, wherein embossings 10 extend in the orthogonal direction relative to the longitudinal direction 4 over an area of between one third and three quarters of the lateral surface 8 and extend over an area of less than one quarter of a lateral surface 8 adjoining this lateral surface 8 and embossings 10 separate therefrom extend in the orthogonal direction relative to the longitudinal direction 4 over an area of less than one quarter of the lateral surface 8 and extend over an area of more than three quarters of the lateral surface 8 adjoining this lateral surface 8 and into the transition area 22.

Figure 12:
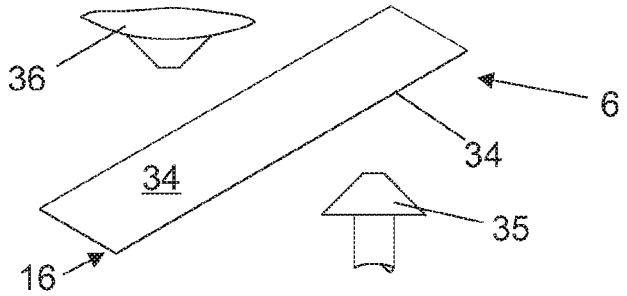
FIG. 12 is a schematic representation of a metal sheet before the embossing and bending to form the profile of a rail.

FIG. 12 shows a metal sheet 6 before the introduction of embossings 10 and a bending procedure. The embossings 10 can generally be introduced after a bending procedure, wherein the embossings 10 are particularly preferably introduced into the metal sheet 6 before the bending procedure.

By way of example, a method for producing a drawer pull-out guide 1 can be effected as follows using the example of the drawer rail 3 according to FIG. 5*b:* the flat steel sheet 6 with a longitudinal direction 4 and two top surfaces 34 is provided as a semifinished product of the drawer rail 3, the metal sheet 6 is provided with an embossing 10 on a top surface 34, by an embossing die 35 or an embossing roller 36, wherein the embossing 10 is arranged orthogonal to the longitudinal direction 4, the metal sheet 6 is bent, with the result that, in a cross section 5 orthogonal to the longitudinal direction 4, a profile 9 of the drawer rail 3 is formed and the embossing 10 extends over two lateral surfaces 8 of the profile 9 arranged orthogonal to each other for reinforcing the profile 9.

By way of example, a method for producing a drawer pull-out guide can be effected as follows using the example of a carcass rail 2 according to FIG. 6*a:* the flat steel sheet 6 with the longitudinal direction 4 and the two top surfaces 34 is provided as a semifinished product of the carcass rail 2, the metal sheet 6 is provided with an embossing 10 on both top surfaces 34 in each case, by the embossing die 35 and the embossing roller 36 (wherein two embossing dies 35 or two embossing rollers 36 are preferably provided), wherein the embossings 10 are arranged orthogonal to the longitudinal direction 4, the metal sheet 6 is bent, with the result that, in a cross section 5 orthogonal to the longitudinal direction 4, a profile 9 of the carcass rail 2 is formed and the at least two embossings 10 face in the direction of the inner area 11 and in the direction of the outer area 12 of the carcass rail 2 in an alternating manner.

The invention claimed is:

1. A drawer pull-out guide for movably mounting a drawer on a furniture carcass, comprising:

a carcass rail to be fastened to the furniture carcass; and a drawer rail to be connected to the drawer, the drawer rail being mounted so as to be displaceable relative to the carcass rail in a longitudinal direction, wherein at least one of the carcass rail and the drawer rail has, in a cross section normal to the longitudinal direction, a profile formed from at least one flat metal sheet with two longitudinal edges running parallel to each other, wherein at least one embossing is arranged for reinforcing the profile of the at least one of the carcass rail and the drawer rail, the at least one embossing extending at least partially over at least two lateral surfaces of the profile, the at least two lateral surfaces of the profile being arranged substantially orthogonal to each other, wherein the at least two lateral surfaces extend in the longitudinal direction and the at least one embossing is arranged substantially orthogonal to the longitudinal direction, wherein the at least one of the carcass rail and the drawer rail is the drawer rail or the at least one embossing faces away from an interior of the profile of the at least one of the carcass rail and the drawer rail, or at least two embossings are arranged for reinforcing the profile of the at least one of the carcass rail and the drawer rail, wherein the at least two embossings include a first embossing and a second embossing that are adjacent to each other, and the at least two embossings are arranged in an alternating manner such that the first embossing faces an interior of the profile of the at least one of the carcass rail and the drawer rail and the second embossing faces away from the interior of the profile of the at least one of the carcass rail and the drawer rail.

2. The drawer pull-out guide according to claim 1, further comprising at least one carriage with at least one rolling body or sliding body arranged on the drawer pull-out guide, wherein the drawer pull-out guide includes the at least one embossing, and the at least one embossing is arranged on the at least one of the carcass rail and the drawer rail in such a way that the at least one embossing is traversable contactlessly in the longitudinal direction by the at least one carriage having the at least one rolling body or sliding body, or the drawer pull-out guide includes the at least two embossings, and the at least two embossings are arranged on the at least one of the carcass rail and the drawer rail in such a way that the at least two embossings are traversable contactlessly in the longitudinal direction by the at least one carriage having the at least one rolling body or sliding body.

3. The drawer pull-out guide according to claim 1, wherein the profile of the at least one of the carcass rail and the drawer rail has at least one fold with at least a double material thickness of the metal sheet on at least one longitudinal edge.

4. The drawer pull-out guide according to claim 2, wherein at least one lateral surface of the profile, on which at least one fold is arranged, forms a track for a linear movement of the at least one carriage along the longitudinal direction.

5. The drawer pull-out guide according to claim 3, wherein the drawer pull-out guide includes the at least two embossings, wherein the profile of the at least one of the carcass rail and the drawer rail has the at least one fold on two longitudinal edges, the first embossing is arranged on a lateral surface having one of the two longitudinal edges with the at least one fold, and the second embossing is arranged on a lateral surface which does not have one of the two longitudinal edges with the at least one fold.

6. The drawer pull-out guide according to claim 1, wherein the profile of the at least one of the carcass rail and the drawer rail has a first fold which faces the interior of the profile of the at least one of the carcass rail and the drawer rail, and a second fold which faces away from the interior of the at least one of the carcass rail and the drawer rail.

7. The drawer pull-out guide according to claim 4, wherein the at least one fold comprises at least one reinforcing device.

8. The drawer pull-out guide according to claim 1, further comprising at least one limit stop arranged on at least two lateral surfaces of the at least one of the carcass rail and the drawer rail, the at least two lateral surfaces being substantially orthogonal to each other.

9. The drawer pull-out guide according to claim 8, wherein:

the drawer pull-out guide includes the at least one embossing, and the at least one limit stop is arranged parallel to the at least one embossing with a lateral offset; or the drawer pull-out guide includes the at least two embossings, and the at least one limit stop is arranged parallel to one of the at least two embossings with a lateral offset.

10. The drawer pull-out guide according to claim 9, wherein:

the drawer pull-out guide includes the at least one embossing, and the at least one embossing is arranged in an end area of the at least one of the carcass rail and the drawer rail relative to the longitudinal direction; or the drawer pull-out guide includes the at least two embossings, and the one of the at least two embossings is arranged in an end area of the at least one of the carcass rail and the drawer rail relative to the longitudinal direction.

11. The drawer pull-out guide according to claim 1, wherein the metal sheet has a material thickness in the range from 0.5 mm to 1.5 mm.

12. The drawer pull-out guide according to claim 1, wherein the drawer pull-out guide includes the at least two embossing, and wherein the at least two embossings comprises at least one group of precisely three embossings arranged on the at least two lateral surfaces of the profile of the at least one of the carcass rail and the drawer rail, the at least two lateral surfaces of the profile being arranged substantially orthogonal to each other.

13. The drawer pull-out guide according to claim 1, wherein the drawer pull-out guide includes the at least two embossings, wherein the at least two embossings are arranged on the same lateral surface or on the same lateral surfaces extending over the at least two lateral surfaces of the profile, or are arranged on the at least two lateral surfaces in an alternating manner.

14. The drawer pull-out guide according to claim 1, wherein the drawer pull-out guide includes the at least two embossings, wherein the at least two embossings include a third embossing, wherein the first and third embossings both face the interior of the profile of the at least one of the carcass rail and the drawer rail, and the second embossing is arranged between the first and third embossings and faces away from the interior of the profile of the at least one of the carcass rail and the drawer rail to increase a tensile/compressive strength.

15. The drawer pull-out guide according to claim 1, wherein:

the drawer pull-out guide includes the at least one embossing, and the at least one embossing is formed pyramid-shaped or truncated-pyramid-shaped at least in an area of a lateral surface of the profile of the at least one of the carcass rail and the drawer rail; or the drawer pull-out guide includes the at least two embossings, and the at least two embossings are each formed pyramid-shaped or truncated-pyramid-shaped at least in an area of one of the at least two lateral surfaces of the profile of the at least one of the carcass rail and the drawer rail.

16. The drawer pull-out guide according to claim 1, wherein:

the drawer pull-out guide includes the at least one embossing, the at least two lateral surfaces adjoin each other, and the at least one embossing extends along one of the at least two lateral surfaces in an orthogonal direction relative to the longitudinal direction of the at least one of the carcass rail and the drawer rail over a length of between one third and three quarters of the one of the at least two lateral surfaces in the orthogonal direction, or extends over a length of less than one third of another of the at least two lateral surfaces in the orthogonal direction; or the drawer pull-out guide includes the at least two embossings, and each of the at least two embossings extends along a first lateral surface of the profile in an orthogonal direction relative to the longitudinal direction of the at least one of the carcass rail and the drawer rail over a length of between one third and three quarters of the first lateral surface in the orthogonal direction, or extends in the orthogonal direction over a length of less than one third of a second lateral surface adjoining the first lateral surface.

17. The drawer pull-out guide according to claim 1, wherein the drawer pull-out guide includes the at least two embossings, wherein the at least two lateral surfaces adjoin each other, and one of the first and second embossings extends in an orthogonal direction relative to the longitudinal direction over a length of between one third and three quarters of one of the at least two lateral surfaces in the orthogonal direction and extends over a length of less than one third of another of the at least two lateral surfaces, and the other of the first and second embossings extends in the orthogonal direction over a length of less than one third of the one of the at least two lateral surfaces in the orthogonal direction and extends over a length of at least three quarters of the another of the at least two lateral surfaces.

18. The drawer pull-out guide according to claim 1, wherein the drawer pull-out guide includes the at least one embossing, wherein the at least one embossing extends substantially over an entire length, in a direction oriented orthogonal to the longitudinal direction, of the at least two lateral surfaces, or the at least one embossing comprises two embossing surfaces arranged parallel to each other.

19. The drawer pull-out guide according to claim 1, wherein;

the drawer pull-out guide includes the at least one embossing, the profile comprises a step on at least one lateral surface, and the at least one embossing extends across the step of the profile; or the drawer pull-out guide includes the at least two embossings, the profile comprises a step on at least one of the at least two lateral surfaces, and the at least two embossings extend across the step of the profile.

20. The drawer pull-out guide according to claim 1, wherein the at least one of the carcass rail and the drawer rail has at least one fastening portion with a fastening first side which, during installation on the furniture carcass or at least one furniture part, is configured to be brought to rest at least partially against the furniture carcass or the at least one furniture part, wherein the at least one fastening portion has at least one opening for a fastening means to pass through, wherein the at least one opening, on a second side spaced apart from the fastening first side by a material thickness of the fastening portion is surrounded by a ridge which protrudes transversely from the second side.

21. A method for producing at least one drawer pull-out guide according to claim 1, comprising:

providing a flat metal sheet with a longitudinal direction and a top surface and a bottom surface as a semifinished product of the at least one of the carcass rail and the drawer rail;

providing the metal sheet with the at least one embossing on at least one of the top surface and the bottom surface, wherein the at least one embossing is arranged substantially orthogonal to the longitudinal direction; and bending the metal sheet such that, in a cross section orthogonal to the longitudinal direction, the profile of the at least one of the carcass rail and the drawer rail is formed and the at least one embossing extends at least partially over the at least two lateral surfaces of the profile arranged substantially orthogonal to each other for reinforcing the profile.

22. The method for producing the drawer pull-out guide according to claim 1, comprising:

providing a flat metal sheet with a longitudinal direction and a top surface and a bottom surface as a semifinished product of the at least one of the carcass rail and the drawer rail;

providing the metal sheet with the first embossing of the at least two embossings on one of the top surface and the bottom surface and the second embossing of the at least two embossings on the other of the top surface and the bottom surface, wherein the at least two embossings are arranged substantially orthogonal to the longitudinal direction; and bending the metal sheet such that, in a cross section orthogonal to the longitudinal direction, the profile of the at least one of the carcass rail and the drawer rail is formed and the first embossing of the at least two embossings faces the interior of the profile of the at least one of the carcass rail and the drawer rail and the second embossing of the at least two embossings faces away from the interior of the profile of the at least one of the carcass rail and the drawer rail.

23. The method according to claim 22, wherein the at least two lateral surfaces of the at least one of the carcass rail and the drawer rail are substantially orthogonally arranged with respect to each other, and wherein the at least two embossings are arranged on the at least two lateral surfaces in such a way that the at least two embossings are arranged:

adjoining each other in the longitudinal direction, or on the same lateral surface or the same lateral surfaces, or on the at least two lateral surfaces in an alternating manner, or in a transition area of the at least two lateral surfaces in an alternating manner.

24. The drawer pull-out guide according to claim 1, wherein the drawer pull-out guide includes the at least two embossings, and the at least two embossings adjoin each other in the longitudinal direction.

25. The drawer pull-out guide according to claim 15, wherein:

the drawer pull-out guide includes the at least one embossing, and the at least one embossing comprises three substantially flat embossing surfaces or two embossing surfaces which form an acute angle; or the drawer pull-out guide includes the at least two embossings, and each of the at least two embossings comprises three substantially flat embossing surfaces or two embossing surfaces which form an acute angle.

* * * * *